US010689593B2

(12) United States Patent
Gibson et al.

(10) Patent No.: US 10,689,593 B2
(45) Date of Patent: Jun. 23, 2020

(54) LOW VISCOSITY LUBRICATING OIL COMPOSITIONS FOR TURBOMACHINES

(71) Applicants: ExxonMobil Research and Engineering Company, Annandale, NJ (US); General Electric Company, Schenectady, NY (US)

(72) Inventors: Meredith R. Gibson, Philadelphia, PA (US); Angela S. Galiano-Roth, Mullica Hill, NJ (US); Jessica L. Prince, Cherry Hill, NJ (US); Andrea B. Wardlow, Newark, DE (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 186 days.

(21) Appl. No.: 15/852,184

(22) Filed: Dec. 22, 2017

(65) Prior Publication Data

US 2018/0119050 A1 May 3, 2018

Related U.S. Application Data

(63) Continuation-in-part of application No. 14/460,410, filed on Aug. 15, 2014.

(Continued)

(51) Int. Cl.
*C10M 169/04* (2006.01)
*C10M 171/02* (2006.01)

(52) U.S. Cl.
CPC ..... *C10M 169/042* (2013.01); *C10M 171/02* (2013.01); *C10M 2203/1006* (2013.01);

(Continued)

(58) Field of Classification Search
CPC ..... C10N 2240/12; C10N 2240/121; C10N 2240/14
See application file for complete search history.

(56) References Cited

U.S. PATENT DOCUMENTS 1,350,257 A 8/1920 Kasbohm
1,390,359 A 9/1921 Kehoe (Continued)

FOREIGN PATENT DOCUMENTS

CA 1094044 A 1/1981
EP 0464547 A1 7/1990

(Continued)

OTHER PUBLICATIONS

Othmer, "Encyclopedia of Chemical Technology", 2nd Edition, vol. 7, pp. 22-37, Interscience Publishers, New York (1965).

(Continued)

*Primary Examiner* — Ellen M McAvoy
(74) *Attorney, Agent, or Firm* — Robert A. Migliorini

(57) ABSTRACT

This disclosure relates to a low viscosity lubricating turbine oil having a composition comprising a lubricating oil base stock, as a major component, and one or more lubricating oil additives, as minor components. The lubricating turbine oil has a kinematic viscosity of about 16 cSt to about 22 cSt at 40° C., a density of about 0.8 g/ml to about 0.9 g/ml, and an absolute evaporation loss at 150° C. of less than about 4%. This disclosure also relates to a method for improving energy efficiency in a turbomachine lubricated with the low viscosity lubricating turbine oil. This disclosure further relates to a method for improving energy efficiency while maintaining or improving deposit control and lubricating oil additive solvency in a turbomachine lubricated with the low viscosity lubricating turbine oil. This disclosure yet further relates to a method for improving solubility, compatibility (Continued)

| | | | Comparative Example | Example 1 | Example 2 | Example 3 | Example 4 |
|---|---|---|---|---|---|---|---|
| | | | Commercial ISO VG 32 | 3.6cst PAO, 16% Grp V (AN 5 and Ester co-base) | 4 cST GTL, 3% AN 5 co-base | 4 cST GTL, 16% Grp V (AN 5 and Ester co-base) | 10 cSt Ester |
| | | Additive System | A | B | C | B | C |
| | | API Base Oils | II | IV/V | III | III/V | V |
| Test Method | Description | Units | | | | | |
| ASTM D445 | Viscosity at 40 C | cSt | 31.9 | 17.2 | 19.1 | 19.7 | 9.5 |
| ASTM D445 | Viscosity at 100 C | cSt | 5.6 | 3.8 | 4.2 | 4.23 | 2.7 |
| ASTM D2270 | Viscosity Index | None | 110 | 126 | 124 | 120 | 127 |
| ASTM D1298 | Density at 60F (15C) | g/mL | 0.86 | 0.838 | 0.821 | 0.8371 | 0.9185 |
| ASTM D92 | Flash Point, COC | °C | 265 | 230 | 224 | 234 | 226 |
| ASTM D1500 | Color | Scale | L0.5 | - | - | L0.5 | L0.5 |
| ASTM D974 | Pour Point | °C | -21 | -60 | -33 | -36 | -30 |
| ASTM D974 | Total Acid Number | mgKOH/g | 0.07 | 0.14 | 0.07 | 0.12 | 0.09 |

(Cont.)

| | | | Comparative Example | Example 1 | Example 2 | Example 3 | Example 4 |
|---|---|---|---|---|---|---|---|
| | | | Commercial ISO VG 32 | 3.6cst PAO, 16% Grp V (AN 5 and Ester co-base) | 4 cST GTL, 3% AN 5 co-base | 4 cST GTL, 16% Grp V (AN 5 and Ester co-base) | 10 cSt Ester |
| | | Additive System | A | B | C | B | C |
| | | API Base Oils | II | IV/V | III | III/V | V |
| Test Method | Description | Units | | | | | |
| ASTM D665 | Rust Prevention-A | Rating | Pass | Pass | Pass | Pass | - |
| ASTM D130 | Copper Corrosion | Rating | 1b | 1a | 1a | 1a | 1b |
| ASTM D892 | Foam Sequence I (Tendency/Stability) | ml/ml | 0/0 | 10/0 | 0/0 | 10/0 | 0/0 |
| ASTM D892 | Foam Sequence II (Tendency/Stability) | ml/ml | 0/0 | 10/0 | 0/0 | 10/0 | 0/0 |
| ASTM D892 | Foam Sequence III (Tendency/Stability) | ml/ml | 0/0 | 20/0 | 10/0 | 10/0 | 0/0 |
| ASTM D943 | Turbine Oxidation Stability | minutes | meets | meets | meets | meets | meets |
| ASTM D2272 | RPVOT | minutes | 950 | 1901 | 1204 | 1780 | 1030 |

and dispersancy of polar additives in the low viscosity lubricating turbine oil.

31 Claims, 11 Drawing Sheets

Related U.S. Application Data

(60) Provisional application No. 62/440,512, filed on Dec. 30, 2016.

(52) U.S. Cl.
CPC ..... *C10M 2203/1025* (2013.01); *C10M 2205/0285* (2013.01); *C10M 2205/173* (2013.01); *C10M 2205/223* (2013.01); *C10M 2207/2835* (2013.01); *C10M 2207/2855* (2013.01); *C10N 2230/02* (2013.01); *C10N 2230/04* (2013.01); *C10N 2230/18* (2013.01); *C10N 2230/54* (2013.01); *C10N 2230/74* (2013.01); *C10N 2240/12* (2013.01); *C10N 2240/14* (2013.01)

(56) References Cited

U.S. PATENT DOCUMENTS 1,429,494 A 9/1922 Diehl
1,440,230 A 12/1922 Mestekin
1,815,022 A 7/1931 Davis
2,015,748 A 10/1935 Frolich
2,100,993 A 11/1937 Bruson
2,191,498 A 2/1940 Reiff
2,387,501 A 10/1945 Dietrich
2,501,731 A 3/1950 Mertes
2,616,911 A 11/1952 Asseff et al.
2,655,479 A 10/1953 Munday et al.
2,666,746 A 1/1954 Munday et al.
2,721,877 A 10/1955 Popkin et al.
2,777,874 A 1/1957 Asseff et al.
2,817,693 A 12/1957 Koome et al.
3,036,003 A 5/1962 Verdol
3,087,936 A 4/1963 LeSuer
3,172,892 A 3/1965 LeSuer et al.
3,200,107 A 8/1965 LeSuer
3,215,707 A 11/1965 Rense
3,219,666 A 11/1965 Norman et al.
3,250,715 A 5/1966 Wyman
3,254,025 A 5/1966 LeSuer
3,272,746 A 9/1966 LeSuer et al.
3,275,554 A 9/1966 Wagenaar
3,316,177 A 4/1967 Dorer, Jr.
3,320,162 A 5/1967 Axe et al.
3,322,670 A 5/1967 Burt et al.
3,329,658 A 7/1967 Fields
3,341,542 A 9/1967 LeSuer et al.
3,384,585 A 5/1968 Gragson et al.
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 van der Voort et al.
3,454,607 A 7/1969 LeSuer et al.
3,488,284 A 1/1970 LeSuer
3,519,565 A 7/1970 Coleman
3,541,012 A 11/1970 Stuebe
3,565,804 A 2/1971 Honnen et al.
3,576,923 A 4/1971 Randell et al.
3,595,791 A 7/1971 Cohen
3,629,109 A 12/1971 Gergel et al.
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,742,082 A 6/1973 Brennan
3,751,365 A 8/1973 Piasek et al.
3,755,433 A 8/1973 Miller et al.
3,756,953 A 9/1973 Piasek et al.
3,769,363 A 10/1973 Brennan
3,787,374 A 1/1974 Adams
3,798,165 A 3/1974 Piasek et al.
3,803,039 A 4/1974 Piasek et al.
3,822,209 A 7/1974 Knapp et al.
3,876,720 A 4/1975 Heilman et al.
3,948,800 A 4/1976 Meinhardt
4,100,082 A 7/1978 Clason et al.
4,218,330 A 8/1980 Shubkin
4,234,435 A 11/1980 Meinhardt et al.
4,239,930 A 12/1980 Allphin et al.
4,263,150 A 4/1981 Clason et al.
4,289,635 A 9/1981 Schroeck
4,298,486 A 11/1981 Horodysky et al.
4,308,154 A 12/1981 Clason et al.
4,328,113 A 5/1982 Horodsky et al.
4,367,352 A 1/1983 Watts, Jr. et al.
4,370,248 A 1/1983 Horodsky et al.
4,374,032 A 2/1983 Gemmill et al.
4,376,712 A 3/1983 Horodsky et al.
4,382,006 A 5/1983 Horodsky
4,389,322 A 6/1983 Horodsky
4,406,802 A 9/1983 Horodsky et al.
4,413,156 A 11/1983 Watts, Jr. et al.
4,417,990 A 11/1983 Clason et al.
4,426,305 A 1/1984 Malec
4,434,408 A 2/1984 Baba et al.
4,454,059 A 6/1984 Pindar et al.
4,472,289 A 9/1984 Horodsky et al.
4,474,920 A 10/1984 Kyminas et al.
4,478,732 A 10/1984 Horodsky et al.
4,522,734 A 6/1985 Horodsky et al.
4,537,692 A 8/1985 Horodsky et al.
4,541,941 A 9/1985 Horodsky et al.
4,568,472 A 2/1986 Horodsky et al.
4,594,171 A 6/1986 Horodsky et al.
4,594,172 A 6/1986 Sie
4,652,416 A 3/1987 Millot
4,692,257 A 9/1987 Horodsky
4,752,416 A 6/1988 Scharf et al.
4,767,551 A 8/1988 Hunt et al.
4,792,410 A 12/1988 Schwind et al.
4,798,684 A 1/1989 Salomon
4,827,064 A 5/1989 Wu
4,827,073 A 5/1989 Wu
4,889,647 A 12/1989 Rowan et al.
4,897,178 A 1/1990 Best et al.
4,910,355 A 3/1990 Shubkin et al.
4,921,594 A 5/1990 Miller
4,943,672 A 7/1990 Hammer et al.
4,952,739 A 8/1990 Chen
4,956,122 A 9/1990 Watts et al.
4,975,177 A 12/1990 Garwood et al.
4,978,464 A 12/1990 Coyle et al.
5,068,487 A 11/1991 Theriot
5,075,269 A 12/1991 Degnan et al.
5,084,197 A 1/1992 Galic et al.
5,110,488 A 5/1992 Tipton et al.
5,275,749 A 1/1994 Kugel et al.
5,354,485 A 10/1994 Tipton et al.
5,430,105 A 7/1995 Redpath et al.
5,705,458 A 1/1998 Roby et al.
6,034,039 A 3/2000 Gomes et al.
6,080,301 A 6/2000 Berlowitz et al.
6,090,989 A 7/2000 Trewella et al.
6,165,949 A 12/2000 Berlowitz et al.
6,323,164 B1 11/2001 Liesen et al.
7,691,792 B1 4/2010 Fisher et al.

(56) References Cited

U.S. PATENT DOCUMENTS

| | | | | |
|---|---|---|---|---|
| 7,704,930 | B2 | 4/2010 | Deckman et al. | |
| 8,048,833 | B2 | 11/2011 | Habeeb et al. | |
| 2003/0119682 | A1 | 6/2003 | Saini et al. | |
| 2004/0224860 | A1* | 11/2004 | Baba | C10M 133/06 508/545 |
| 2008/0020950 | A1 | 1/2008 | Gray et al. | |
| 2008/0096779 | A1* | 4/2008 | Okazaki | C10M 107/02 508/459 |
| 2009/0318320 | A1* | 12/2009 | Kaneko | C10M 141/06 508/304 |
| 2010/0075875 | A1* | 3/2010 | Yaguchi | C10M 169/04 508/192 |
| 2011/0039743 | A1* | 2/2011 | Bagheri | C10M 107/10 508/591 |
| 2013/0029891 | A1* | 1/2013 | Okazaki | C10M 169/04 508/279 |
| 2013/0029893 | A1* | 1/2013 | Okazaki | C10M 169/04 508/496 |
| 2013/0225459 | A1* | 8/2013 | Bagheri | C07C 11/02 508/110 |
| 2015/0099675 | A1* | 4/2015 | Hum | C10M 101/02 508/110 |
| 2016/0002565 | A1* | 1/2016 | Schmid | C10M 169/04 508/150 |
| 2016/0376518 | A1* | 12/2016 | Rettemeyer | C10M 169/041 508/499 |

FOREIGN PATENT DOCUMENTS

| | | | |
|---|---|---|---|
| EP | 0464546 | A1 | 1/1992 |
| EP | 0471071 | B1 | 8/1995 |
| EP | 9931113 | A1 | 6/1999 |
| EP | 1040115 | B1 | 6/2004 |
| WO | 8803144 | A1 | 5/1988 |

OTHER PUBLICATIONS

International Search Report and Written Opinion PCT/US2017/068630 dated Mar. 20, 2018.

* cited by examiner

Fig. 1

| | | | Comparative Example | Example 1 | Example 2 | Example 3 | Example 4 |
|---|---|---|---|---|---|---|---|
| | | | Commercial ISO VG 32 | 3.6cst PAO, 16% Grp V (AN 5 and Ester co-base) | 4 cST GTL, 3% AN 5 co-base | 4 cST GTL, 16% Grp V (AN 5 and Ester co-base) | 10 cSt Ester |
| | | **Additive System** | A | B | C | B | C |
| | | **API Base Oils** | II | IV/V | III | III/V | V |
| **Test Method** | **Description** | **Units** | | | | | |
| ASTM D445 | Viscosity at 40 C | cSt | 31.9 | 17.2 | 19.1 | 19.7 | 9.5 |
| ASTM D445 | Viscosity at 100 C | cSt | 5.6 | 3.8 | 4.2 | 4.23 | 2.7 |
| ASTM D2270 | Viscosity Index | None | 110 | 126 | 124 | 120 | 127 |
| ASTM D1298 | Density at 60F (15C) | g/mL | 0.86 | 0.838 | 0.821 | 0.8371 | 0.9185 |
| ASTM D92 | Flash Point, COC | °C | 265 | 230 | 224 | 234 | 226 |
| ASTM D1500 | Color | Scale | L0.5 | - | - | L0.5 | L0.5 |
| ASTM D974 | Pour Point | °C | -21 | -60 | -33 | -36 | -30 |
| ASTM D974 | Total Acid Number | mgKOH/g | 0.07 | 0.14 | 0.07 | 0.12 | 0.09 |

Fig. 1 (Cont.)

| | | | Comparative Example | Example 1 | Example 2 | Example 3 | Example 4 |
|---|---|---|---|---|---|---|---|
| | | | Commercial ISO VG 32 | 3.6cst PAO, 16% Grp V (AN 5 and Ester co-base) | 4 cST GTL, 3% AN 5 co-base | 4 cST GTL, 16% Grp V (AN 5 and Ester co-base) | 10 cSt Ester |
| | | **Additive System** | A | B | C | B | C |
| | | **API Base Oils** | II | IV/V | III | III/V | V |
| **Test Method** | **Description** | **Units** | | | | | |
| ASTM D665 | Rust Prevention-A | Rating | Pass | Pass | Pass | Pass | - |
| ASTM D130 | Copper Corrosion | Rating | 1b | 1a | 1a | 1a | 1b |
| ASTM D892 | Foam Sequence I (Tendency/Stability) | ml/ml | 0/0 | 10/0 | 0/0 | 10/0 | 0/0 |
| ASTM D892 | Foam Sequence II (Tendency/Stability) | ml/ml | 0/0 | 10/0 | 0/0 | 10/0 | 0/0 |
| ASTM D892 | Foam Sequence III (Tendency/Stability) | ml/ml | 0/0 | 20/0 | 10/0 | 10/0 | 0/0 |
| ASTM D943 | Turbine Oxidation Stability | minutes | meets | meets | meets | meets | meets |
| ASTM D2272 | RPVOT | minutes | 950 | 1901 | 1204 | 1780 | 1030 |

Fig. 1 (Cont.)

| | | | Comparative Example | Example 1 | Example 2 | Example 3 | Example 4 |
|---|---|---|---|---|---|---|---|
| | | | Commercial ISO VG 32 | 3.6cst PAO, 16% Grp V (AN 5 and Ester co-base) | 4 cST GTL, 3% AN 5 co-base | 4 cST GTL, 16% Grp V (AN 5 and Ester co-base) | 10 cSt Ester |
| | | **Additive System** | A | B | C | B | C |
| | | **API Base Oils** | II | IV/V | III | III/V | V |
| **Test Method** | **Description** | **Units** | | | | | |
| ASTM D3427 | Air Release at 50C, time to 0.2% air | minutes | 2 | 1.32 | 0.7 | 1.2 | 0.3 |
| ASTM D972 | Evaporation Loss-22h@150C | mass% | 2.87 | 1.94 | 1.71 | 2.13 | 5.59 |
| ASTM D5800 | NOACK Proc B | % | 8.6 | 11.6 | 11.6 | 10.8 | 25.8 |
| M1567 | Simulated Distillation 5% off | °F | 717 | 770 | 744 | 726 | 685 |
| M1567 | Simulated Distillation 10% off | °F | 758 | 778 | 755 | 748 | 725 |
| | Specific Heat at typical turbine operating temp | | 3.025 | 3.217 | 3.048 | 3.010 | 3.362 |
| | Measured Bearing Efficiency Gain | % | reference=0 | 27.05 | 13.65 | 9.13 | 5.78 |

Fig. 1 (Cont.)

| | | | Example 5 | GE GEK 32568J Specification |
|---|---|---|---|---|
| | | | 4 cST GTL, 3% AN 5 co-base | |
| | | **Additive System** | A | |
| | | **API Base Oils** | III/V | |
| **Test Method** | **Description** | **Units** | | |
| ASTM D445 | Viscosity at 40 C | cSt | 18.58 | 28.8-35.2 |
| ASTM D445 | Viscosity at 100 C | cSt | 4.081 | - |
| ASTM D2270 | Viscosity Index | None | 121 | 95 min |
| ASTM D1298 | Density at 60F (15C) | g/mL | 0.8201 | report |
| ASTM D92 | Flash Point, COC | °C | 229 | - |
| ASTM D1500 | Color | Scale | - | 2.0max |
| ASTM D974 | Pour Point | °C | -39 | -12max |
| ASTM D974 | Total Acid Number | mgKOH/g | 0.08 | 0.2max |

Fig. 1 (Cont.)

| | | | Example 5 | GE GEK 32568J Specification |
|---|---|---|---|---|
| | | | 4 cST GTL, 3% AN 5 co-base | |
| | | **Additive System** | A | |
| | | **API Base Oils** | III/V | |
| **Test Method** | **Description** | **Units** | | |
| ASTM D665 | Rust Prevention-A | Rating | Pass | Pass min |
| ASTM D130 | Copper Corrosion | Rating | 1b | 1b max |
| ASTM D892 | Foam Sequence I (Tendency/Stability) | ml/ml | 0/0 | 50/0 max |
| ASTM D892 | Foam Sequence II (Tendency/Stability) | ml/ml | 0/0 | 50/0 max |
| ASTM D892 | Foam Sequence III (Tendency/Stability) | ml/ml | 0/0 | 50/0 max |
| ASTM D943 | Turbine Oxidation Stability | minutes | meets | 5000 min |
| ASTM D2272 | RPVOT | minutes | 1052 | 500 min |

Fig. 1 (Cont.)

| | | | Example 5 | GE GEK 32568J Specification |
|---|---|---|---|---|
| | | | 4 cST GTL, 3% AN 5 co-base | |
| | | **Additive System** | A | |
| | | **API Base Oils** | III/V | |
| **Test Method** | **Description** | **Units** | | |
| ASTM D3427 | Air Release at 50C, time to 0.2% air | minutes | 0.4 | 5.0 max |
| ASTM D972 | Evaporation Loss-22h@150C | mass% | 2.05 | - |
| ASTM D5800 | NOACK Proc B | % | 11.2 | - |
| M1567 | Simulated Distillation 5% off | °F | 744 | - |
| M1567 | Simulated Distillation 10% off | °F | 756 | - |
| | Specific Heat at typical turbine operating temp | | 2.891 | |
| | Measured Bearing Efficiency Gain | % | 19.94 | |

Fig. 2

| | Example | 1 | 4 | 3 | 2 | 5 | Comparative 1 |
|---|---|---|---|---|---|---|---|
| **Description** | **Additive System** | B | C | B | C | A | A |
| 4 cSt GTL (Group III) Base Oil | | | | 81.484 | 95.437 | 96.380 | |
| 5 cSt Alkylated Naphthalene (Group V) Base Oil | | 10.000 | 3.000 | 10.000 | 3.000 | 3.000 | |
| 8 cSt Phthalate Ester (Group V) Base Oil | | 6.000 | | 6.000 | | | |
| Ashless Phosphate Antiwear | | 1.500 | | 1.500 | | | |
| Aromatic Aminic Antioxidant | | 0.400 | | 0.400 | | | |
| Sulfur-free Phenolic Antioxidant 1 | | 0.400 | | 0.400 | | | |
| Succinimide Corrosion Inhibitor 1 | | | | 0.200 | | | |
| Silicon Anti-Foam Additive | | 0.010 | 0.010 | 0.010 | 0.010 | | |

Fig. 2 (Cont.)

| | Example | 1 | 4 | 3 | 2 | 5 | Comparative 1 |
|---|---|---|---|---|---|---|---|
| **Description** | **Additive System** | B | C | B | C | A | A |
| Tolytriazole Corrosion Inhibitor | | 0.006 | 0.010 | 0.006 | 0.010 | | |
| Polyol Ester Base Oil (Group V) | | | 95.437 | | | | |
| Succinimide Corrosion Inhibitor 2 | | | 0.200 | | 0.200 | | |
| Sulfur-free Phenolic Antioxidant 2 | | | 0.300 | | 0.300 | | |
| Polyglycol Demulsifier | | | 0.005 | | 0.005 | | |
| Boron-containing Dispersant | | | 0.400 | | 0.400 | | |
| Phosporus-containing Demulsifier | | | 0.020 | | 0.020 | | |
| PANA Aminic Anti-Oxidant | | | 0.300 | | 0.300 | | |

Fig. 2 (Cont.)

| | Example | 1 | 4 | 3 | 2 | 5 | Comparative 1 |
|---|---|---|---|---|---|---|---|
| **Description** | **Additive System** | B | C | B | C | A | A |
| Aromatic Aminic Antioxidant 2 | | | 0.300 | | 0.300 | | |
| Ashless Dithiophosphate Antiwear | | | 0.008 | | 0.008 | | |
| Thiadiazole Corrosion Inhibitor | | | 0.010 | | 0.010 | | |
| 3 cSt GTL (Group III) Base Oil | | | | | | | |
| 3.6 cSt PAO (Group IV) Base Oil | | 81.584 | | | | | |
| 150" HPN (Group II) Base Oil | | | | | | | 99.380 |
| Acid Amide Corrosion Inhibitor | | 0.100 | | | | | |
| Turbine Oil R&O Additive Package | | | | | | 0.620 | 0.620 |

Fig. 3

| | Lubricating Efficiency Factor | ASTM D445 Viscosity at 40°C | ASTM D1298 Density at 40°C |
|---|---|---|---|
| **Comparative Example 1** | -0.87 | 31.9 | 0.8416 |
| **Example 1** | 22.10 | 17.2 | 0.8219 |
| **Example 2** | 19.11 | 19.1 | 0.8055 |
| **Example 3** | 14.76 | 19.7 | 0.8211 |
| **Example 4** | 6.23 | 9.5 | 0.9005 |
| **Example 5** | 14.27 | 18.58 | 0.8047 |

Lubricating Efficiency Factor = [19.200(Specific Heat)] - [6.679(Evaporation Loss)] - [1.028(Dynamic Viscosity)] - 12.178

Fig. 3 (Cont.)

| | ASTM D972 Evaporation Loss-22h@150°C | Dynamic Viscosity | Specific Heat |
|---|---|---|---|
| **Comparative Example 1** | 2.87 | 26.8 | 3.025 |
| **Example 1** | 1.94 | 14.1 | 3.217 |
| **Example 2** | 1.71 | 15.4 | 3.048 |
| **Example 3** | 2.13 | 16.2 | 3.01 |
| **Example 4** | 5.59 | 8.6 | 3.3615 |
| **Example 5** | 2.05 | 15.0 | 2.891 |

LOW VISCOSITY LUBRICATING OIL COMPOSITIONS FOR TURBOMACHINES

CROSS-REFERENCE TO RELATED APPLICATIONS

This application is a Continuation-in-Part Application and claims priority to U.S. Provisional Application Ser. No. 62/440,512 filed Dec. 30, 2016 and U.S. application Ser. No. 14/460,410 filed Aug. 15, 2014, which are both herein incorporated by reference in their entirety.

FIELD

This disclosure relates to a low viscosity lubricating turbine oil. This disclosure also relates to a method for improving energy efficiency in a turbomachine lubricated with the low viscosity lubricating turbine oil. This disclosure further relates to a method for improving energy efficiency while maintaining or improving deposit control and lubricating oil additive solvency in a turbomachine lubricated with the low viscosity lubricating turbine oil. This disclosure yet further relates to a method for improving solubility, compatibility and dispersancy of polar additives in the low viscosity lubricating turbine oil.

BACKGROUND

Turbine oils used in power generation applications play an important role in heat removal and temperature reduction of turbine bearings. Reduction in turbine bearing temperatures translates into increased energy efficiency and additional electricity generation from the turbine. This reduction in turbine bearing temperatures can also reduce the amount of system cooling required, therefore providing additional energy savings.

In power generation applications, there is a need for energy efficiency resulting in more electricity (KW) output for the same fuel input. In a power generation plant operating 8000 hours per year, 164 kW additional output can be achieved at similar firing rates, based on at least a 10% turbine bearing efficiency improvement with about 0.1% overall system efficiency benefit. A 0.05%/kW improvement potentially offers $66,000 annual value per turbine in electricity available for sale.

In one possible solution, these energy efficiency gains may be achieved through a change to lower viscosity turbine lube oil. Currently, equipment builders (EB) and original equipment manufacturers (OEM) require a minimum turbine lubricating oil viscosity of 32 cSt at 40° C. However, a problem with lower viscosity turbine lube oils is that they do not meet the physical property constraints for acceptable use in turbine applications.

Despite advances in turbine lubricant oil technology, there exists a need for an oil lubricant for turbine bearings that effectively improves turbine energy efficiency. In addition, there exists a need for a turbine oil lubricant that effectively improves energy efficiency while maintaining or improving deposit control and lubricating oil additive solvency.

SUMMARY

This disclosure relates in part to a lubricating oil having a composition comprising a lubricating oil base stock, as a major component, and one or more lubricating oil additives, as minor components. The lubricating oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972. The lubricating oil is preferably a lubricating turbine oil.

This disclosure also relates in part to a method for improving energy efficiency in a turbomachine lubricated with a lubricating oil by using as the lubricating oil a formulated oil. The formulated oil has a composition comprising a lubricating oil base stock, as a major component, and one or more lubricating oil additives, as minor components. The formulated oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972.

In an embodiment, for a turbomachine, energy efficiency is improved as compared to energy efficiency achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

In an embodiment, for a turbomachine, bearing temperature is reduced as compared to bearing temperature achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

In an embodiment, for a turbomachine, energy efficiency is improved and deposit control and lubricating oil additive solvency are maintained or improved as compared to energy efficiency, deposit control and lubricating oil additive solvency achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

This disclosure also relates in part to a method of improving solubility, compatibility and/or dispersancy of polar lubricating oil additives in a nonpolar lubricating oil base stock. The method comprises: providing a lubricating oil comprising a nonpolar lubricating oil base stock as a major component and one or more polar lubricating oil additives as a minor component; and blending at least one co-base stock in the lubricating oil. The lubricating oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972.

This disclosure yet further relates in part to a method for achieving significant energy efficiency gains in a turbomachine. The method comprises selecting a lubricating oil comprising a nonpolar lubricating oil base stock as a major component and one or more polar lubricating oil additives as a minor component. The lubricating oil has a specific heat from about 3.0 J/g·° C. to about 3.3 J/g·° C., an absolute evaporation loss at 150° C. of less than about 4% according to ASTM D972, and a kinematic viscosity of about 16 cSt to about 22 cSt at 40° C. according to ASTM D445. The method further comprises selecting the nonpolar lubricating oil base stock or combinations thereof, to maximize energy saving potential, such that the lubricating oil possesses a Lubricating Efficiency Factor of at least about 10, preferably at least about 12, and more preferably at least about 14, according to the following formula:

Lubricating Efficiency Factor=[19.200(Specific Heat)]−[6.679(Evaporation Loss)]−[1.028(Dynamic Viscosity)]−12.178.

It has been surprisingly found that, in accordance with this disclosure, low viscosity turbine lubricating oils can be formulated that have physical properties needed for acceptable use in turbine applications. The turbine lubricating oils of this disclosure have a kinematic viscosity of about 16 cSt to about 22 cSt at 40° C. In contrast, conventional turbine lubricating oils require a minimum viscosity of 32 cSt at 40° C.

Also, it has been surprisingly found that, in accordance with this disclosure, improvements in energy efficiency in a turbomachine can be obtained using a lubricating oil having a kinematic viscosity of about 16 cSt to about 22 cSt at 40° C., a density of about 0.8 g/ml to about 0.9 g/ml, and an absolute evaporation loss at 150° C. of less than about 4%.

Further, it has been surprisingly found that, in accordance with this disclosure, bearing temperature can be reduced in a turbomachine using a lubricating oil having a kinematic viscosity of about 16 cSt to about 22 cSt at 40° C., a density of about 0.8 g/ml to about 0.9 g/ml, and an absolute evaporation loss at 150° C. of less than about 4%.

Yet further, it has been surprisingly found that, in accordance with this disclosure, energy efficiency can be improved and deposit control and lubricating oil additive solvency can be maintained or improved in a turbomachine using a lubricating oil having a kinematic viscosity of about 16 cSt to about 22 cSt at 40° C., a density of about 0.8 g/ml to about 0.9 g/ml, and an absolute evaporation loss at 150° C. of less than about 4%.

In particular, it has been surprisingly found that, in accordance with this disclosure, viscosity reduction alone is not sufficient to achieve significant energy efficiency improvement in turbine oils. Balancing viscosity with volatility and density requirements is important for achieving the improved energy efficiency results.

Other objects and advantages of the present disclosure will become apparent from the detailed description that follows.

BRIEF DESCRIPTION OF THE DRAWINGS

FIG. 1 is a table of formulations, including base oils and additive systems, and properties of the formulations determined in accordance with the Examples.

FIG. 2 is a table of detailed formulations, including base oils and additives, prepared in accordance with the Examples.

FIG. 3 is a table showing the Lubricating Efficiency Factor and related properties of the formulations, determined in accordance with the Examples.

DETAILED DESCRIPTION

All numerical values within the detailed description and the claims herein are modified by "about" or "approximately" the indicated value, and take into account experimental error and variations that would be expected by a person having ordinary skill in the art.

In accordance with this disclosure, enhanced temperature reduction and energy efficiency benefits are achieved compared to conventional turbine oils when tested in a bearing efficiency rig test. The low viscosity turbine oils of this disclosure reduce churning and other viscous losses. The low density turbine oils of this disclosure yield improved heat transfer resulting in enhanced heat removal and lower bearing temperature at the same pump flow rates relative to present commercial turbine oils. The turbine oils of this disclosure overcome the technical challenge of balancing oil film, volatility and flash concerns. With the turbine oils of this disclosure, hydrodynamic bearing lubrication is achieved with minimal potential for metal to metal contact. Smoother surfaces allow for less shaft to journal bearing clearances—thinner oil. In addition, tin babbitted bearings allow for transient boundary lubrication.

In an embodiment, this disclosure uses a mixture of low viscosity/low density hydrocarbons, e.g., a base stock and a co-base stock, outside the typical turbine oil viscosity range of ISO VG 32, 46, and 68 and still within the physical property constraints of acceptable use in turbine applications, to provide an unexpected energy efficiency benefit.

The turbine oils of this disclosure are outside the conventional turbine oil viscosity range, and importantly within the physical property constraints of acceptable use in turbine applications. By reducing viscosity while maintaining the performance characteristics of a conventional turbine oil, this disclosure provides additional energy savings in power plants without detriment to performance or increased risk of mechanical failure.

Important performance criteria for the turbine oils of this disclosure include, for example, exhibiting at least 10%, preferably at least 12%, and more preferably at least 14%, energy efficiency improvement while meeting the following requirements: a flash point greater than 215° C.; absolute maximum evaporation loss less than 4%; balanced low viscosity candidate with low specific heat/low density; and maintains all bearing protection and lubricant requirements.

Balancing viscosity reduction with volatility and density requirements is important for achieving the unexpected efficiency results. Turbine oils of this disclosure with lower density provide overall better energy efficiency gain. This is believed to be due to the density of a lubricant related to its specific heat capacity and overall heat control. In addition, Group V base stocks can be added to further enhance these performance attributes and provide the additive solvency and deposit control necessary for reliability in the turbine application.

As used herein, turbine or turbomachine refers to a machine for producing continuous power in which a wheel or rotor, typically fitted with vanes, is made to revolve by a fast-moving flow of water, steam, gas, air, or other fluid. The turbine or turbomachine has at least one moving part called a rotor assembly, which is a shaft or drum with blades attached. Moving fluid acts on the blades so that they move and impart rotational energy to the rotor. A preferred turbomachine is a gas turbine, or a combined cycle comprising a gas turbine and a steam turbine.

It has been found that, in a turbomachine, improved energy efficiency can be obtained as compared to energy efficiency achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

Also, it has been found that, in a turbomachine, bearing temperature can be reduced as compared to bearing temperature achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

Further, it has been found that, in a turbomachine, energy efficiency can be improved and deposit control and lubricating oil additive solvency can be maintained or improved as compared to energy efficiency, deposit control and lubricating oil additive solvency achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

As described herein, the low viscosity turbine lubricating oils of this disclosure have physical properties needed for acceptable use in turbine applications. Such physical properties include, for example, density, absolute evaporation loss, Noack volatility, flash point, and specific heat.

The turbine lubricating oils of this disclosure have a kinematic viscosity of about 16 cSt to about 22 cSt at 40° C. according to ASTM D445. In contrast, conventional turbine lubricating oils require a minimum viscosity of 32 cSt at 40° C. Preferably, the turbine lubricating oils of this disclosure have a kinematic viscosity of about 17 cSt to about 21 cSt at 40° C., and more preferably a kinematic viscosity of about 18 cSt to about 20 cSt at 40° C.

In accordance with this disclosure, the turbine lubricating oils of this disclosure have a density needed for acceptable use in turbine applications. The turbine lubricating oils of this disclosure have a density of about 0.8 g/ml to about 0.9 g/ml according to ASTM D1298. Preferably, the turbine lubricating oils of this disclosure have a density of about 0.81 g/ml to about 0.89 g/ml, and more preferably a density of about 0.82 g/ml to about 0.88 g/ml.

Also, in accordance with this disclosure, the turbine lubricating oils of this disclosure have an absolute evaporation loss needed for acceptable use in turbine applications. The turbine lubricating oils of this disclosure have an absolute evaporation loss at 150° C. of less than about 4% according to ASTM D972. Preferably, the turbine lubricating oils of this disclosure have an absolute evaporation loss at 150° C. of less than about 3%, and more preferably an absolute evaporation loss at 150° C. of less than about 2%.

Further, in accordance with this disclosure, the turbine lubricating oils of this disclosure have a Noack volatility needed for acceptable use in turbine applications. The turbine lubricating oils of this disclosure have a Noack volatility of less than about 15% according to ASTM D5800. Preferably, the turbine lubricating oils of this disclosure have a Noack volatility of less than about 12%, and more preferably Noack volatility of less than about 10%.

Yet further, in accordance with this disclosure, the turbine lubricating oils of this disclosure have a flash point needed for acceptable use in turbine applications. The turbine lubricating oils of this disclosure have a flash point greater than about 215° C. according to ASTM D92. Preferably, the turbine lubricating oils of this disclosure have a flash point greater than about 220° C., and more preferably a flash point greater than about 225° C.

Still further, in accordance with this disclosure, the turbine lubricating oils of this disclosure have a specific heat needed for acceptable use in turbine applications. The turbine lubricating oils of this disclosure have a specific heat from about 3.0 J/g·° C. to about 3.3 J/g·° C. Preferably, the turbine lubricating oils of this disclosure have a specific heat from about 3.05 J/g·° C. to about 3.25 J/g·° C., and more preferably specific heat from about 3.1 J/g·° C. to about 3.2 J/g·° C.

In addition to desired energy efficiency, deposit control and lubricating oil additive solvency, the present disclosure provides turbine lubricant compositions with desired antiwear properties. Antiwear additives are generally required for reducing wear in turbine operating equipment where two solid surfaces engage in contact. In the absence of antiwear chemistry, the surfaces can rub together causing material loss on one or both surfaces which can eventually lead to equipment malfunction and failure. Antiwear additives can produce a protective surface layer which reduces wear and material loss. Most commonly the materials of interest are metals such as steel and other iron-containing alloys. However, other materials such as ceramics, polymer coatings, diamond-like carbon, corresponding composites, and the like can also be used to produce durable surfaces in modern turbine equipment. The turbine lubricant compositions of this disclosure can provide antiwear properties to such surfaces.

Lubricating Oil Base Stocks and Co-Base Stocks

A wide range of lubricating base oils is known in the art. Lubricating base oils that are useful in the present disclosure are natural oils, mineral oils and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org) to create guidelines for lubricant base oils. Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III stocks have a viscosity index greater than about 120 and contain less than or equal to about 0.03% sulfur and greater than about 90% saturates. Group IV includes polyalphaolefins (PAO). Group V base stock includes base stocks not included in Groups I-IV. Table 1 below summarizes properties of each of these five groups.

TABLE 1

Properties of Base Oil Groups

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |

TABLE 1-continued

| Properties of Base Oil Groups | | | |
|---|---|---|---|
| | Base Oil Properties | | |
| | Saturates | Sulfur | Viscosity Index |
| Group IV | polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{12}$ to $C_{18}$ may be used to provide low viscosity base stocks of acceptably low volatility. Depending on the viscosity grade and the starting oligomer, the PAOs may be predominantly dimers, trimers and tetramers of the starting olefins, with minor amounts of the lower and/or higher oligomers, having a viscosity range of 1.5 cSt to 12 cSt. PAO fluids of particular use may include 3 cSt, 3.4 cSt, and/or 3.6 cSt and combinations thereof. Mixtures of PAO fluids having a viscosity range of 1.5 cSt to approximately 150 cSt or more may be used if desired. Unless indicated otherwise, all viscosities cited herein are measured at 100° C.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 2 cSt to about 50 cSt, preferably about 2 cSt to about 30 cSt, more preferably about 3 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl biphenyls, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{20}$ often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 2 cSt to about 50 cSt are preferred, with viscosities of approximately 3 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Alkylated naphthalene and analogues may also comprise compositions with isomeric distribution of alkylating groups on the alpha and beta carbon positions of the ring structure. Distribution of groups on the alpha and beta positions of a naphthalene ring may range from 100:1 to 1:100, more often 50:1 to 1:50 Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnC_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Turbine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorus and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base oil constitutes the major component of the turbine oil lubricant composition of the present disclosure and typically is present in an amount ranging from about 80 to about 99.8 weight percent, preferably from about 90 to about 99.5 weight percent, and more preferably from about 95 to about 99 weight percent, based on the total weight of the composition. The base oil may be selected from any of the synthetic or natural oils typically used as lubricating oils for industrial oils and turbomachines. The base oil conveniently has a kinematic viscosity, according to ASTM standards, of about 7 cSt to about 46 cSt (or $mm^2/s$) at 40° C. and preferably of about 10 cSt to about 32 cSt (or $mm^2/s$) at 40° C., often more preferably from about 15 cSt to about 22 cSt. Mixtures of synthetic and natural base oils may be used if desired. Bi-modal, tri-modal, and additional combinations of mixtures of Group I, II, III, IV, and/or V base stocks may be used if desired.

The co-base stock component is present in an amount sufficient for providing solubility, compatibility and dispersancy of polar additives in the lubricating oil. The co-base stock component is present in the lubricating oils of this disclosure in an amount from about 1 to about 99 weight percent, preferably from about 5 to about 95 weight percent, and more preferably from about 10 to about 90 weight percent.

Table 2 below summarizes useful and preferred amounts of illustrative lubricating base oils in accordance with this disclosure.

TABLE 2

Useful and Preferred Amounts of Illustrative Lubricating Base Oils

| Illustrative Base Oils | Approximate wt % (Useful) | Approximate wt % (Preferred) |
|---|---|---|
| Mineral Oil API Group I, II/II+ | 0-100 | 3-95 |
| Naphthenic | 0-100 | 3-95 |
| API Group III/III+ = GTL | 0-100 | 3-95 |
| API Group IV PAO | 0-100 | 3-95 |
| API Group V (examples listed below): | 0-100 | 3-95 |
| Ethylene-propylene copolymer (EPC) | 0-100 | 3-95 |
| Polyol Esters | 0-100 | 3-95 |
| Phosphate Esters | 0-100 | 3-95 |
| Phthalate Esters | 0-100 | 3-95 |
| Dibasic Esters e.g. Adipate | 0-100 | 3-95 |
| Carbonate Esters | 0-100 | 3-95 |
| Trimellitate Esters | 0-100 | 3-95 |
| Oil Soluble Polyalkylene Glycols | 0-100 | 3-95 |
| Polyalkylene Glycols | 0-100 | 3-95 |
| Alkylated Naphthalenes | 0-100 | 3-95 |
| Viscobase Fluids | 0-100 | 3-95 |
| Olefin-esters (e.g. Ketjenlube) | 0-100 | 3-95 |
| Linear or Branched Alkylbenzenes | 0-100 | 3-95 |
| TME-based esters | 0-100 | 3-95 |
| Polyethers | 0-100 | 3-95 |
| 2 Ethylhexanoic acid ester | 0-100 | 3-95 |
| PMA/PAO co-oligomers | 0-100 | 3-95 |
| Alkylated Diphenyl Oxide (ADPO) | 0-100 | 3-95 |
| Alkylated Sulfurized Diphenyl Oxide (ASDPO) | 0-100 | 3-95 |
| Bisphenol Sulfide Ether (BPSE) | 0-100 | 3-95 |
| (C16,C20) 3-phenylpropionate | 0-100 | 3-95 |
| Hexyl 2-(decyloxy)benzoate | 0-100 | 3-95 |
| Diheptyl N-octylsuccinate | 0-100 | 3-95 |

Lubricating Oil Additives

The formulated lubricating oil useful in the present disclosure may additionally contain one or more of the commonly used lubricating oil performance additives including but not limited to antiwear additives, dispersants, detergents, viscosity modifiers, corrosion inhibitors, rust inhibitors, metal deactivators, extreme pressure additives, anti-seizure agents, wax modifiers, viscosity modifiers, fluid-loss additives, seal compatibility agents, lubricity agents, anti-staining agents, chromophoric agents, defoamants, demulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973); see also U.S. Pat. No. 7,704,930, the disclosure of which is incorporated herein in its entirety. These additives are commonly delivered with varying amounts of diluent oil, that may range from 5 weight percent to 50 weight percent.

The additives useful in this disclosure do not have to be soluble in the lubricating oils. Insoluble additives in oil can be dispersed in the lubricating oils of this disclosure.

The types and quantities of performance additives used in combination with the instant disclosure in lubricant compositions are not limited by the examples shown herein as illustrations.

Antiwear Additives

Alkyldithiophosphates, aryl phosphates and phosphites are illustrative antiwear additives useful in the lubricating oils of this disclosure. The illustrative antiwear additives may be essentially free of metals, or they may contain metal salts.

A phosphate ester or salt may be a monohydrocarbyl, dihydrocarbyl or a trihydrocarbyl phosphate, wherein each hydrocarbyl group is saturated. In one embodiment, each hydrocarbyl group independently contains from about 8 to about 30, or from about 12 up to about 28, or from about 14 up to about 24, or from about 14 up to about 18 carbons atoms. In an embodiment, the hydrocarbyl groups are alkyl groups. Examples of hydrocarbyl groups include tridecyl, tetradecyl, pentadecyl, hexadecyl, heptadecyl, octadecyl groups and mixtures thereof.

A phosphate ester or salt is a phosphorus acid ester prepared by reacting one or more phosphorus acid or anhydride with a saturated alcohol. The phosphorus acid or anhydride is generally an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters generally contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of C18-C28 primary alcohols having mostly C20 alcohols as determined by GLC (gas-liquid-chromatography)); and Alfol22+ alcohols (C18-C28 primary alcohols containing primarily C22 alcohols). Alfol alcohols are available from Continental Oil Company. Another example of a commercially available alcohol mixture is Adol 60 (about 75% by weight of a straight chain C22 primary alcohol, about 15% of a C20 primary alcohol and about 8% of C18 and C24 alcohols). The Adol alcohols are marketed by Ashland Chemical.

A variety of mixtures of monohydric fatty alcohols derived from naturally occurring triglycerides and ranging in chain length from C8 to C18 are available from Procter & Gamble Company. These mixtures contain various amounts of fatty alcohols containing 12, 14, 16, or 18 carbon atoms. For example, CO-1214 is a fatty alcohol mixture containing 0.5% of C10 alcohol, 66.0% of C12 alcohol, 26.0% of C14 alcohol and 6.5% of C16 alcohol.

Another group of commercially available alcohol mixtures include the "Neodol" products available from Shell Chemical Co. For example, Neodol 23 is a mixture of C12 and C13 alcohols; Neodol 25 is a mixture of C12 to C15 alcohols; and Neodol 45 is a mixture of C14 to C15 linear alcohols. The phosphate contains from about 14 to about 18 carbon atoms in each hydrocarbyl group. The hydrocarbyl groups of the phosphate are generally derived from a mixture of fatty alcohols having from about 14 up to about 18 carbon atoms. The hydrocarbyl phosphate may also be derived from a fatty vicinal diol. Fatty vicinal diols include those available from Ashland Oil under the general trade designation Adol 114 and Adol 158. The former is derived from a straight chain alpha olefin fraction of C11-C14, and the latter is derived from a C15-C18 fraction.

The phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

Illustrative monoamines generally contain a hydrocarbyl group which contains from 1 to about 30 carbon atoms, or from 1 to about 12, or from 1 to about 6. Examples of primary monoamines useful in the present disclosure include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine is a fatty (C8-C30) amine which includes n-octylamine, n-decylamine, n-dodecylamine, n-tetradecylamine, n-hexadecylamine, n-octadecylamine, oleyamine, etc. Also useful fatty amines include commercially available fatty amines such as "Armeen" amines (products available from Akzo Chemicals, Chicago, Ill.), such Armeen C, Armeen O, Armeen OL, Armeen T, Armeen HT, Armeen S and Armeen SD, wherein the letter designation relates to the fatty group, such as coco, oleyl, tallow, or stearyl groups.

Other useful amines include primary ether amines, such as those represented by the formula $$R''(OR')_xNH_2$$

wherein R' is a divalent alkylene group having about 2 to about 6 carbon atoms; x is a number from one to about 150, or from about one to about five, or one; and R" is a hydrocarbyl group of about 5 to about 150 carbon atoms. An example of an ether amine is available under the name SURFAM® amines produced and marketed by Mars Chemical Company, Atlanta, Ga. Preferred etheramines are exemplified by those identified as SURFAM P14B (decyloxypropylamine), SURFAM P16A (linear C16), SURFAM P17B (tridecyloxypropylamine). The carbon chain lengths (i.e., C14, etc.) of the SURFAMS described above and used hereinafter are approximate and include the oxygen ether linkage.

An illustrative amine is a tertiary-aliphatic primary amine. Generally, the aliphatic group, preferably an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, and tert-octacosanylamine. Mixtures of tertiary aliphatic amines may also be used in preparing the phosphate salt. Illustrative of amine mixtures of this type are "Primene 81R" which is a mixture of C11-C14 tertiary alkyl primary amines and "Primene JMT" which is a similar mixture of C18-C22 tertiary alkyl primary amines (both are available from Rohm and Haas Company). The tertiary aliphatic primary amines and methods for their preparation are known to those of ordinary skill in the art.

Another illustrative amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters are prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. Preferably, the metal is magnesium, calcium, manganese or zinc. Examples of metal compounds which may be reacted with the phosphorus acid include zinc hydroxide, zinc oxide, copper hydroxide, copper oxide, etc.

The lubricating oils of this disclosure also may include a fatty imidazoline or a reaction product of a fatty carboxylic acid and at least one polyamine. The fatty imidazoline has fatty sub stituents containing from 8 to about 30, or from about 12 to about 24 carbon atoms. The substituent may be saturated or unsaturated, for example, heptadeceneyl derived olyel groups, preferably saturated. In one aspect, the fatty imidazoline may be prepared by reacting a fatty carboxylic acid with a polyalkylenepolyamine. The fatty carboxylic acids are generally mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, preferably 2. The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). Preferably, the fatty carboxylic acids are fatty monocarboxylic acids, having from about 8 to about 30, preferably about 12 to about 24 carbon atoms, such as octanoic, oleic, stearic, linoleic, dodecanoic, and tall oil acids, preferably stearic acid. The fatty carboxylic acid is reacted with at least one polyamine. The polyamines may be aliphatic, cycloaliphatic, heterocyclic or aromatic. Examples of the polyamines include alkylene polyamines and heterocyclic polyamines.

The antiwear additive according to the disclosure has the following advantges. It has very high effectiveness when used in low concentrations and it is free of chlorine. For the neutralization of the phosphoric esters, the latter are taken and the corresponding amine slowly added with stirring. The resulting heat of neutralization is removed by cooling. The antiwear additive according to the disclosure can be incorporated into the respective base liquid with the aid of fatty substances (e.g., tall oil fatty acid, oleic acid, etc.) as solubilizers. The base liquids used are napthenic or paraffinic base oils, synthetic oils (e.g., polyglycols, mixed polyglycols), polyolefins, carboxylic esters, etc.

In an embodiment, the lubricating oils of this disclosure can contain at least one phosphorus containing antiwear additive. Examples of such additives are amine phosphate antiwear additives such as that known under the trade name IRGALUBE 349 and/or triphenyl phosphorothionate antiwear additives such as that known under the trade name IRGALUBE TPPT. Such amine phosphates may be present in an amount of from 0.01 to 2%, preferably 0.2 to 1.5% by weight of the lubricant composition while such phosphorothionates are suitably present in an amount of from 0.01 to 3%, preferably 0.5 to 1.5% by weight of the lubricant composition. A mixture of an amine phosphate and phosphorothionate may be employed.

Neutral organic phosphates may be present in an amount from zero to 4%, preferably 0.1 to 2.5% by weight of the composition. The above amine phosphates can be mixed together to form a single component capable of delievering antiwear performance. The neutral organic phosphate is also a conventional ingredient of lubricating oils.

Phosphates for use in the present disclosure include phosphates, acid phosphates, phosphites and acid phosphites. The phosphates include triaryl phosphates, trialkyl phosphates, trialkylaryl phosphates, triarylalkyl phosphates and trialkenyl phosphates. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

The phosphites include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, and trioleyl phosphite.

The acid phosphites include, for example, dibutyl hydrogenphosphite, dilauryl hydrogenphosphite, dioleyl hydrogenphosphite, distearyl hydrogenphosphite, and diphenyl hydrogenphosphite.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, di stearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount from zero to 5% by weight, preferably from 0.1 to 2% by weight, relative to the total weight of the composition.

Illustrative carboxylic acids to be reacted with amines include, for example, aliphatic carboxylic acids, dicarboxylic acids (dibasic acids), and aromatic carboxylic acids. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, and linoleic acid. Specific examples of the dicarboxylic acids include octadecylsuccinic acid, octadecenylsuccinic acid, adipic acid, azelaic acid, and sebacic acid. One example of the aromatic carboxylic acids is salicylic acid. Illustrative amines to be reacted with carboxylic acids include, for example, polyalkylene-polyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine. Of these, preferred are a combination of isostearic acid and tetraethylenepentamine, and a combination of oleic acid and diethanolamine. Reaction products of carboxylic acids and amines may added to the base oil in an amount of from zero to 5% by weight, preferably from 0.03 to 3% by weight, relative to the total weight of the composition.

Other illustrative antiwear additives include phosphites, thiophosphites, phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Specific examples of some of the phosphites and thiophosphites within the scope of the disclosure include phosphorous acid, mono-, di-, or tri-thiophosphorous acid, mono-, di-, or tri-propyl phosphite or mono-, di-, or tri-thiophosphite; mono-, di-, or tri-butyl phosphite or mono-, di-, or tri-thiophosphite; mono-, di-, or tri-amyl phosphite or mono-, di-, or tri-thiophosphite; mono-, di-, or tri-hexyl phosphite or mono-, di-, or tri-thiophosphite; mono-, di-, or tri-phenyl phosphite or mono-, di-, or tri-thiophosphite; mono-, di-, or tri-tolyl phosphite or mono-, di-, or tri-thiophosphite; mono-, di-, or tri-cresyl phosphite or mono-, di-, or tri-thiophosphite; dibutyl phenyl phosphite or mono-, di-, or tri-phosphite, amyl dicresyl phosphite or mono-, di-, or tri-thiophosphite, and any of the above with substituted groups, such as chlorophenyl or chlorobutyl.

Specific examples of the phosphates and thiophosphates within the scope of the disclosure include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

These phosphorus compounds may be prepared by well known reactions. One route the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain (C9 to C22) phosphorus esters have been prepared by reaction of dimethylphosphite with a mixture of medium-chain alcohols by means of a thermal transesterification or an acid- or base-catalyzed transesterification. See, for example, U.S. Pat. No. 4,652,416. Most such materials are also commercially available; for instance, triphenyl phosphite is available from Albright and Wilson as Duraphos TPPTM; di-n-butyl hydrogen phosphite from Albright and Wilson as Duraphos DBHP™; and triphenylthiophosphate from Ciba Specialty Chemicals as Irgalube TPPT™.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

One or more of the above-identified metal dithiophosphates may be used from about zero to about 2% by weight, and more generally from about 0.1 to about 1% by weight, based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this disclosure are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids are prepared by the reaction of a phosphorus sulfide with an alcohol or phenol or mixtures of alcohols. A typical reaction involves four moles of the alcohol or phenol and one mole of phosphorus pentasulfide, and may be carried out within the temperature range from about 50° C. to about 200° C. Thus, the preparation of O,O-di-n-hexyl phosphorodithioic acid involves the reaction of a mole of phosphorus pentasulfide with four moles of n-hexyl alcohol at about 100° C. for about two hours. Hydrogen sulfide is liberated and the residue is the desired acid. The preparation of the metal salts of these acids may be effected by reaction with metal compounds as well known in the art.

The metal salts of dihydrocarbyldithiophosphates which are useful in this disclosure include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids which in turn are prepared by the reaction of phosphorus pentasulfide with mixtures of alcohols. In addition, the use of such mixtures enables the utilization of less expensive alcohols which individually may not yield oil-soluble phosphorodithioic acids. Thus a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Typical esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. More prferentially, the dimethyl-, diethyl-, and dipropyl-oleyl phohphonates can be used. Neutral acids of phosphorus acids are the triesters rather than an acid (HO-P) or a salt of an acid.

Any C4 to C8 alkyl or higher phosphate ester may be employed in the disclosure. For example, tributyl phosphate (TBP) and tri isooctal phosphate (TOF) can be used. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are C1-C18 alkyl groups, preferably C2-C12 alkyl groups. These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

Although their presence is not required to obtain the benefit of this disclosure, ZDDP is typically used in amounts of from about zero to about 3 weight percent, preferably from about 0.05 weight percent to about 2 weight percent, more preferably from about 0.1 weight percent to about 1.5 weight percent, and even more preferably from about 0.1 weight percent to about 1 weight percent, based on the total weight of the lubricating oil, although more or less can often be used advantageously. A secondary ZDDP may be preferred and present in an amount of from zero to 1 weight percent of the total weight of the lubricating oil.

Extreme Pressure, Anti-Scuffing, and Anti-Seize Agents

Extreme pressure agents and sulfur-based extreme pressure agents, such as sulfides, sulfoxides, sulfones, thiophosphinates, thiocarbonates, sulfurized fats and oils, sulfurized olefins and the like; phosphorus-based extreme pressure agents, such as phosphoric acid esters (e.g., tricresyl phosphate (TCP) and the like), phosphorous acid esters, phosphoric acid ester amine salts, phosphorous acid ester amine salts, and the like; halogen-based extreme pressure agents, such as chlorinated hydrocarbons and the like; organometallic extreme pressure agents, such as thiophosphoric acid salts (e.g., zinc dithiophosphate (ZnDTP) and the like) and thiocarbamic acid salts; and the like can be used.

The phosphoric acid ester, thiophosphoric acid ester, and amine salt thereof functions to enhance the lubricating performances, and can be selected from known compounds conventionally employed as extreme pressure agents. Generally employed are phosphoric acid esters, a thiophosphoric acid ester, or an amine salt thereof which has an alkyl group, an alkenyl group, an alkylaryl group, or an aralkyl group, any of which contains approximately 3 to 30 carbon atoms.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. Preferably, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. Preferably, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. Preferably, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performances, and can be selected from known compounds conventionally employed as extreme pressure agents. Generally employed is a phosphorus acid ester or an amine salt thereof which has an alkyl group, an alkenyl group, an alkylaryl group, or an aralkyl group, any of which contains approximately 3 to 30 carbon atoms.

Examples of the phosphorus acid esters include aliphatic phosphorus acid esters such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. Preferably, the phosphorus acid ester is a dialkyl phosphite or a trialkyl phosphite.

The phosphate salt may be derived from a polyamine. The polyamines include alkoxylated diamines, fatty polyamine diamines, alkylenepolyamines, hydroxy containing polyamines, condensed polyamines arylpolyamines, and heterocyclic polyamines. Examples of these amines include Ethoduomeen T/13 and T/20 which are ethylene oxide condensation products of N-tallowtrimethylenediamine containing 3 and 10 moles of ethylene oxide per mole of diamine, respectively.

In another embodiment, the polyamine is a fatty diamine. The fatty diamines include mono- or dialkyl, symmetrical or asymmetrical ethylene diamines, propane diamines (1,2 or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen O (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2nd Edition, Vol. 7, pages 22-37, Interscience Publishers, New York (1965). Ethylenepolyamines are often a complex mixture of polyalkylenepolyamines including cyclic condensation products.

Other useful types of polyamine mixtures are those resulting from stripping of the above-described polyamine mixtures to leave, as residue, what is often termed "polyamine bottoms". In general, alkylenepolyamine bottoms can be characterized as having less than 2%, usually less than 1% (by weight) material boiling below about 200° C. A typical sample of such ethylene polyamine bottoms obtained from the Dow Chemical Company of Freeport, Tex. designated "E-100". These alkylenepolyamine bottoms include cyclic condensation products such as piperazine and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. The hydroxy compounds are preferably polyhydric alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl)aminomethane (THAM).

Polyamines which react with the polyhydric alcohol or amine to form the condensation products or condensed amines, are described above. Preferred polyamines include triethylenetetramine (TETA), tetraethylenepentamine (TEPA), pentaethylenehexamine (PEHA), and mixtures of polyamines such as the above-described "amine bottoms".

Examples of extreme pressure additives include sulphur-based extreme pressure additives such as dialkyl sulphides, dibenzyl sulphide, dialkyl polysulphides, dibenzyl disulphide, alkyl mercaptans, dibenzothiophene and 2,2'-dithiobis(benzothiazole); phosphorus-based extreme pressure additives such as trialkyl phosphates, triaryl phosphates, trialkyl phosphonates, trialkyl phosphites, triaryl phosphites and dialkylhydrozine phosphites, and phosphorus- and sulphur-based extreme pressure additives such as zinc dialkyldithiophosphates, dialkylthiophosphoric acid, trialkyl thiophosphate esters, acidic thiophosphate esters and trialkyl trithiophosphates. Extreme pressure additives can be used individually or in the form of mixtures, conveniently in an amount within the range from zero to 2% by weight of the lubricating oil composition.

Dispersants

During machine operation, oil-insoluble oxidation byproducts are produced. Dispersants help keep these byproducts in solution, thus diminishing their deposition on metal surfaces. Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times Mn)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically Mn, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one C3 to C26 alpha-olefin having the formula $$H_2C=CHR^1$$

wherein $R^1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a C4 refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Dispersants may be used in an amount of zero to 10 weight percent or 0.01 to 8 weight percent, preferably about 0.1 to 5 weight percent, or more preferably 0.5 to 3 weight percent. Or such dispersants may be used in an amount of zero to 8 weight percent, preferably about 0.01 to 5 weight percent, or more preferably 0.1 to 3 weight percent. On an active ingredient basis, such additives may be used in an amount of zero to 10 weight percent, preferably about 0.3 to 3 weight percent. The hydrocarbon portion of the dispersant atoms can range from C60 to C1000, or from C70 to C300, or from C70 to C200. These dispersants may contain both neutral and basic nitrogen, and mixtures of both. Dispersants can be end-capped by borates and/or cyclic carbonates. Nitrogen content in the finished oil can vary from about zero to about 2000 ppm by weight, preferably from about 100 ppm by weight to about 1200 ppm by weight. Basic nitrogen can vary from about zero to about 1000 ppm by weight, preferably from about 100 ppm by weight to about 600 ppm by weight.

Dispersants as described herein are beneficially useful with the compositions of this disclosure. Further, in one embodiment, preparation of the compositions of this disclosure using one or more dispersants is achieved by combining ingredients of this disclosure, plus optional base stocks and lubricant additives, in a mixture at a temperature above the melting point of such ingredients, particularly that of the one or more M-carboxylates (M=H, metal, two or more metals, mixtures thereof).

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur-containing acid, carboxylic acid (e.g., salicylic acid), phosphorus-containing acid, phenol, or mixtures thereof. The counterion is typically an alkaline earth or alkali metal. The detergent can be overbased as described herein.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur-containing acid, a carboxylic acid, a phosphorus-containing acid, and mixtures thereof.

Preferably, the metal salt of an organic or inorganic acid or the metal salt of a phenol comprises calcium phenate, calcium sulfonate, calcium salicylate, magnesium phenate, magnesium sulfonate, magnesium salicylate, an overbased detergent, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Preferably the TBN delivered by the detergent is between 1 and 20. More preferably between 1 and 12. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched C1-C30 alkyl groups, preferably, C4-C20 or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

In accordance with this disclosure, metal salts of carboxylic acids are preferred detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

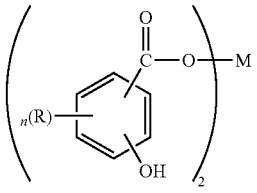

where R is an alkyl group having 1 to about 30 carbon atoms, n is an integer from 1 to 4, and M is an alkaline earth metal. Preferred R groups are alkyl chains of at least C11, preferably C13 or greater. R may be optionally substituted with substituents that do not interfere with the detergent's function. M is preferably, calcium, magnesium, barium, or mixtures thereof. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate. Overbased detergents are also preferred.

Although their presence is not required to obtain the benefit of this disclosure, detergent concentration in the lubricating oils of this disclosure can range from zero to about 6.0 weight percent, preferably zero to 5.0 weight percent, and more preferably from about 0.01 weight percent to about 3.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

A-B wherein A is a polymeric block derived predominantly from vinyl aromatic hydrocarbon monomer, and B is a polymeric block derived predominantly from conjugated diene monomer.

Although their presence is not required to obtain the benefit of this disclosure, viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the lubricating oil composition. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-.alpha.-naphthalamine. These are used in turbine, circulation, and hydraulic oils that are intended for extended service.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with C6+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Further examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butyl-phenol, 2-t-butyl-4-methoxyphenol, 3-t-butyl-4-methoxy-phenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl) propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl)propionate and 2'-ethylhexyl-3-(3,5-di-t-butyl-4-hydroxyphenyl)propionate; 2,6-di-t-butyl-alpha-dimethylamino-p-cresol, 2,2'-methylenebis(4-alkyl-6-t-butylphenol) compounds such as 2,2'-methylenebis(4-methyl-6-t-butylphe-nol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), and 4,4'-methylenebis (2,6-di-t-butylphenol) (manufactured by Laporte Performance Chemicals under the trade designation "lonox 220AH").

Other examples of phenol-based antioxidants include 4,4'-bis(2,6-di-t-butylphenol), 2,2-(di-p-hydroxyphenyl) propane (Bisphenol A), 2,2-bis(3,5-di-t-butyl-4-hydroxy-phenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Speciality Chemicals Co. under the trade designation "Irganox L109"), triethylene glycol bis[3-(3-t-butyl-4-hydrox-y-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Speciality Chemicals Co. under the trade designation "Irganox L115"), 3,9-bis{1,1-dimethyl-2-[3-(3-t-butyl-4-hydroxy-5-methyl-phenyl)-propionylo-xy]ethyl}2,4,8,10-tetraoxaspiro[5,5]undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols such as tetrakis[methylene-3-(3,5-di-t-butyl-4-hydroxyphenyl)propionato]methane (manufactured by the Ciba Speciality Chemicals Co. under the trade designation "Irganox L101"), 1,1,3-tris(2-methyl-4-hydroxy-5-t-butylpheny-1)butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Speciality Chemicals under the trade designation "Irganox 330"), bis[3,3'-bis(4'-hydroxy-3'-t-butylpheny-1)butyric acid] glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates such as the condensates of p-t-butylphenol and formaldehyde and the condensates of p-t-butylphenol and acetaldehyde.

The phenolic antioxidants include sulfurized and non-sulfurized phenolic antioxidants. The terms "phenolic type" or "phenolic antioxidant" used herein include compounds having one or more than one hydroxyl group bound to an aromatic ring, which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic antioxidant may be represented by the general formula:

$$(R)_x—Ar—(OH)_y$$

where Ar is selected from the group consisting of:

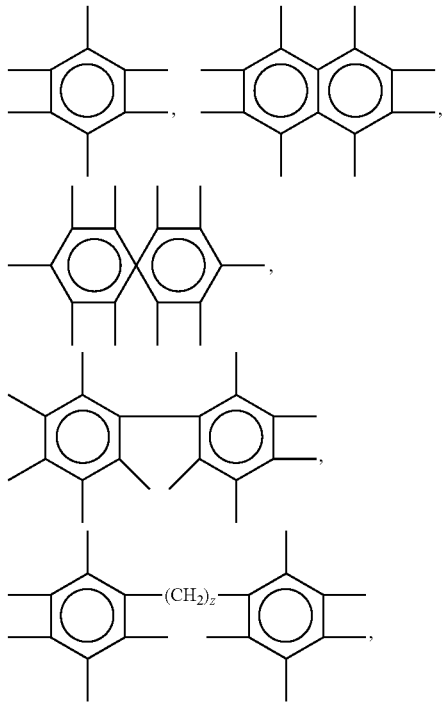

-continued

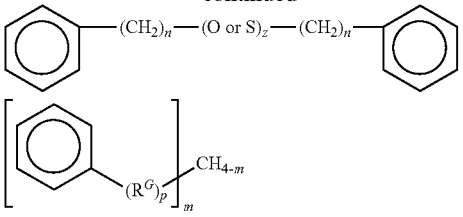

wherein R is a C3-C100 alkyl or alkenyl group, a sulfur substituted alkyl or alkenyl group, preferably a C4-C50 alkyl or alkenyl group or sulfur substituted alkyl or alkenyl group, more preferably C3-C100 alkyl or sulfur substituted alkyl group, most preferably a C4-C50 alkyl group, $R^G$ is a C1-C100 alkylene or sulfur substituted alkylene group, preferably a C2-C50 alkylene or sulfur substituted alkylene group, more preferably a C2-C20 alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic antioxidant compounds are the hindered phenolics and phenolic esters, which contain a sterically hindered hydroxyl group, and these include those derivatives of dihydroxy aryl compounds in which the hydroxyl groups are in the o- or p-position to each other. Typical phenolic antioxidants include the hindered phenols substituted with C1+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

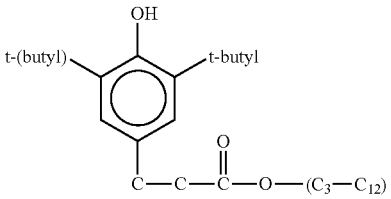

Phenolic type antioxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic antioxidants which can be used.

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $$R^8R^9R^{10}N$$

where $R^8$ is an aliphatic, aromatic or substituted aromatic group, $R^9$ is an aromatic or a substituted aromatic group, and $R^{10}$ is H, alkyl, aryl or $R^{11}S(O)xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Aromatic amine antioxidants include phenyl-α-naphthyl amine, which is described by the following molecular structure:

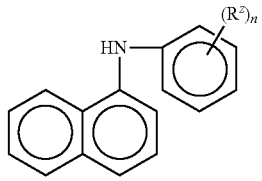

wherein $R^z$ is hydrogen or a C1-C14 linear or C3-C14 branched alkyl group, preferably C1-C10 linear or C3-C10 branched alkyl group, more preferably linear or branched C6-C8 and n is an integer ranging from 1 to 5 preferably 1. A particular example is Irganox L06.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Further examples of amine-based antioxidants include dialkyldiphenylamines such as p,p'-dioctyldiphenylamine (manufactured by the Seiko Kagaku Co. under the trade designation "Nonflex OD-3"), p,p'-di-alpha-methylbenzyldiphenylamine and N-p-butylphenyl-N-p'-octylphenylamine; monoalkyldiphenylamines such as mono-t-butyldiphenylamine, and monooctyldiphenylamine; bis(dialkylphenyl) amines such as di(2,4-diethylphenyl)amine and di(2-ethyl-4-nonylphenyl)amine; alkylphenyl-1-naphthylamines such as octylphenyl-1-naphthylamine and N-t-dodecylphenyl-1-naphthylamine; arylnaphthylamines such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. Of these, preferred are dialkyl thiodipropionates such as dilauryl thiodipropionate and distearyl thiodipropionate.

Examples of sulphur-based antioxidants include dialkylsulphides such as didodecylsulphide and dioctadecylsulphide; thiodipropionic acid esters such as didodecyl thiodipropionate, dioctadecyl thiodipropionate, dimyristyl thiodipropionate and dodecyloctadecyl thiodipropionate, and 2-mercaptobenzimidazole. Sulfurized alkyl phenols and alkali or alkaline earth metal salts thereof also are useful antioxidants.

Other oxidation inhibitors that have proven useful in lube compositions are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Another class of antioxidants which may be used in the lubricating oil compositions disclosed herein are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Preferred antioxidants include hindered phenols, arylamines. These antioxidants may be used individually by type or in combination with one another. Although their presence is not required to obtain the benefit of this disclosure, antioxidant additives may be used in an amount of about 0.01 to 5 weight percent, preferably about 0.1 to 3 weight percent, more preferably 0.1 to 2 weight percent, more preferably 0.1 to 1.5 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Although their presence is not required to obtain the benefit of this disclosure, PPD additives may be used in an amount of zero to 5 weight percent, preferably about 0.01 to 1.5 weight percent.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), polybutenyl succinic anhydride and sulfolane-type seal swell agents such as Lubrizol 730-type seal swell additives. Although their presence is not required to obtain the benefit of this disclosure, seal combatibility additives may be used in an amount of zero to 3 weight percent, preferably about 0.01 to 2 weight percent.

Antifoam Agents

Antifoam agents may advantageously be added to lubricant compositions. These agents retard the formation of stable foams. Foam inhibitors include polymers of alkyl methacrylate especially useful poly alkyl acrylate polymers where alkyl is generally understood to be methyl, ethyl propyl, isopropyl, butyl, or iso butyl and polymers of dimethylsilicone which form materials called dimethylsiloxane polymers in the viscosity range of 100 cSt to 100,000 cSt. Other additives are defoamers, such as silicone polymers which have been post reacted with various carbon containing moieties, are the most widely used defoamers. Organic polymers are sometimes used as defoamers although much higher concentrations are required.

Antifoam agents are commercially available and may be used in conventional minor amounts along with other additives such as demulsifiers. Although their presence is not required to obtain the benefit of this disclosure, usually the amount of these additives combined is less than 1 weight percent and often less than 0.1 weight percent.

Demulsifiers

A demulsifier may advantageously be added to lubricant compositions. The demulsifier is used to separate emulsions (e.g., water in oil). An illustrative demulsifying component is described in EP-A-330,522. It is obtained by reacting an alkylene oxide with an adduct obtained by reaction of a bis-epoxide with a polyhydric alcohol. Demulsifiers are commercially available and may be used in conventional minor amounts along with other additives such as antifoam agents. Although their presence is not required to obtain the benefit of this disclosure, usually the amount of these additives combined is less than 1 weight percent and often less than 0.1 weight percent.

Demulsifying agents include alkoxylated phenols and phenol-formaldehyde resins and synthetic alkylaryl sulfonates such as metallic dinonylnaphthalene sulfonates. A demulsifing agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present disclosure may also be one produced from alkoxylation of n-butanol with a mixture of alkylene oxides to form a random alkoxylated product.

Polyoxyalkylene glycols useful in the present disclosure may be produced by a well-known process for preparing polyalkylene oxide having hydroxyl end-groups by subjecting an alcohol or a glycol ether and one or more alkylene oxide monomers such as ethylene oxide, butylene oxide, or propylene oxide to form block copolymers in addition polymerization while employing a strong base such as potassium hydroxide as a catalyst. In such process, the polymerization is commonly carried out under a catalytic concentration of 0.3 to 1.0% by mole of potassium hydroxide to the monomer(s) and at high temperature, as 100° C. to 160° C. It is well known fact that the potassium hydroxide being a catalyst is for the most part bonded to the chain-end of the produced polyalkylene oxide in a form of alkoxide in the polymer solution so obtained.

An especially preferred family of soluble polyoxyalkylene glycol useful in the compositions of the present disclosure may also be one produced from alkoxylation of n-butanol with a mixture of alkylene oxides to form a random alkoxylated product.

Inhibitors and Antirust Additives

Antirust additives (or corrosion inhibitors) are additives that protect lubricated metal surfaces against chemical attack by water, air or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Although their presence is not required to obtain the benefit of this disclosure, inhibitors and antirust additives may be used in an amount from zero to about 5 weight percent, preferably from 0.01 to about 1.5 weight percent.

Antirust additives include (short-chain) alkenyl succinic acids, partial esters thereof and nitrogen-containing derivatives thereof; and synthetic alkarylsulfonates, such as metal dinonylnaphthalene sulfonates. Anti-rust agents include, for example, monocarboxylic acids which have from 8 to 30 carbon atoms, alkyl or alkenyl succinates or partial esters thereof, hydroxy-fatty acids which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids and paraffin oxides.

Examples of monocarboxylic acids (C8-C30), include, for example, caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid and C8-C24 mercapto-fatty acids.

Examples of polybasic carboxylic acids include, for example, the alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749).

Examples of the alkylamines which function as antirust additives or as reaction products with the above carboxylates to give amides and the like are represented by primary amines such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, di stearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine.

Examples of the aforementioned N-alkylpolyalkyenediamines include: ethylenediamines such as laurylethylenediamine, coconut ethylenediamine, n-tridecylethylenediamine-myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenediamine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentylenediamine, oleylpentylenediamine, beef tallow-pentylenediamine, hydrogenated beef tallow-pentylenediamine and soy bean pentylenediamine.

Metal Passivators, Deactivators and Corrosion Inhibitors

This type of component includes 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present disclosure, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurised in an amount up to 35% by weight. Preferably the acid is a C4 to C22 straight chain unsaturated monocarboxylic acid. The monocarboxylic acid may be a sulphurised oleic acid. However, other suitable materials are oleic acid itself; valeric acid and erucic acid. A component of the anti-corrosion combination is a triazole as previously defined. A preferred triazole is tolylotriazole which may be included in the compositions of the disclosure include triazoles, thiazoles and certain diamine compounds which are useful as metal deactivators or metal passivators. Examples include triazole, benzotriazole and substituted benzotriazoles such as alkyl substituted derivatives. The alkyl substituent generally contains up to 1.5 carbon atoms, preferably up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. Benzotriazole and tolyltriazole are particularly preferred.

Illustrative substituents include, for example, alkyl that is straight or branched chain, for example, methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl; alkenyl that is straight or branched chain, for example, prop-2-enyl, but-2-enyl, 2-methyl-prop-2-enyl, pent-2-enyl, hexa-2,4-dienyl, dec-10-enyl or eicos-2-enyl; cylcoalkyl that is, for example, cyclopentyl, cyclohexyl, cyclooctyl, cyclodecyl, adamantyl or cyclododecyl; aralkyl that is, for example, benzyl, 2-phenylethyl, benzhydryl or naphthylmethyl; aryl that is, for example, phenyl or naphthyl; heterocyclic group that is, for example, a morpholine, pyrrolidine, piperidine or a perhydroazepine ring; alkylene moieties that include, for example, methylene, ethylene, 1:2- or 1:3-propylene, 1:4-butylene, 1:6-hexylene, 1:8-octylene, 1:10-decylene and 1:12-dodecylene.

Illustrative arylene moieties include, for example, phenylene and naphthylene. 1-(or 4)-(dimethylaminomethyl) triazole, 1-(or 4)-(diethylaminomethyl) triazole, 1-(or 4)-(di-isopropylaminomethyl) triazole, 1-(or 4)-(di-n-butylaminomethyl) triazole, 1-(or 4)-(di-n-hexylaminomethyl) triazole, 1-(or 4)-(di-isooctylaminomethyl) triazole, 1-(or 4)-(di-(2-ethylhexyl)aminomethyl) triazole, 1-(or 4)-(di-n-decylaminomethyl) triazole, 1-(or 4)-(di-n-dodecylaminomethyl) triazole, 1-(or 4)-(di-n-octadecylaminomethyl) triazole, 1-(or 4)-(di-n-eicosylaminomethyl) triazole, 1-(or 4)-[di-(prop-2'-enyl) aminomethyl] triazole, 1-(or 4)-[di-(but-2'-enyl) aminomethyl] triazole, 1-(or 4)-[di-(eicos-2'-enyl) aminomethyl] triazole, 1-(or 4)-(di-cyclohexylaminomethyl) triazole, 1-(or 4)-(di-benzylaminomethyl) triazole, 1-(or 4)-(di-phenylaminomethyl) triazole, 1-(or 4)-(4'-morpholinomethyl) triazole, 1-(or 4)-(1'-pyrrolidinomethyl) triazole, 1-(or 4)-(1'-piperidinomethyl) triazole, 1-(or 4)-(1'-perhydoroazepinomethyl) triazole, 1-(or 4)-(2',2"-dihydroxyethyl)aminomethyl] triazole, 1-(or 4)-(dibutoxypropyl-aminomethyl) triazole, 1-(or 4)-(dibutylthiopropyl-aminomethyl) triazole, 1-(or 4)-(di-butylaminopropyl-aminomethyl) triazole, 1-(or-4)-(1-methanomine)-N,N-bis (2-ethylhexyl)-methyl benzotriazole, N,N-bis-(1- or 4-triazolylmethyl) laurylamine, N,N-bis-(1- or 4-triazolylmethyl) oleylamine, N,N-bis-(1- or 4-triazolylmethyl) ethanolamine and N,N,N',N'-tetra(1- or 4-triazolylmethyl) ethylene diamine.

The metal deactivating agents which can be used in the lubricating oil include, for example, benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio) benzothiazole and 2-(octyldithio)benzothiazole; 2-(alkyl-dithio)toluthiazoles such as 2-(benzyldithio)toluthiazole and 2-(octyldithio)toluthiazole, 2-(N,N-dialkyldithiocarbamyl) benzothiazoles such as 2-(N,N-diethyldithiocarbamyl)benzothiazole, 2-(N,N-dibutyldithiocarbamyl)-benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazo-le, 2-(decyldithio)-benzoxazole and 2-(dodecyldithio)benzoxazole; benzoxazole derivatives of 2-(alkyldithio)toluoxazoles such as 2-(octyldithio)toluoxazole, 2-(decyldithio)toluoxazole, 2-(dodecyldithio)toluoxazole; 2,5-bis(alkyldithio)-1,3,4-thiadiazoles such as 2,5-bis(heptyldithio)-1,3,4-thiadiazole, 2,5-bis-(nonyldithio)-1,-3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithioca-rbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyl-dithiocarbamyl-5-mercapto-1,3,4-thiadiazole, and triazole derivatives of 1-alkyl-2,4-triazoles such as 1-dioctylaminomethyl-2,4-triazole or concentrates and/or mixtures thereof.

Although their presence is not required to obtain the benefit of this disclosure, metal deactivators and corrosion inhibitor additives may be present from zero to about 1% by weight, preferably from 0.01% to about 0.5% of the total lubricating oil composition.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating turbine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating turbine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from C3 to C50, can be ethoxylated, propoxylated, or butoxylated to form the corresponding fatty alkyl ethers. The underlying alcohol portion can preferably be stearyl, myristyl, C11-C13 hydrocarbon, oleyl, isosteryl, and the like.

These other friction modifiers would be optionally in addition to the fatty phosphites and fatty imidazolines. A useful list of such other friction modifier additives is included in U.S. Pat. No. 4,792,410. U.S. Pat. No. 5,110,488 discloses metal salts of fatty acids and especially zinc salts, useful as friction modifiers. Fatty acids are also useful friction modifiers. A list of other friction modifiers suitable for disclosure includes: (i) fatty phosphonates; (ii) fatty acid amides; (iii) fatty epoxides; (iv) borated fatty epoxides; (v) fatty amines; (vi) glycerol esters; (vii) borated glycerol esters; (viii) alkoxylated fatty amines; (ix) borated alkoxylated fatty amines; (x) metal salts of fatty acids; (xi) sulfurized olefins; (xii) condensation products of carboxylic acids or equivalents and polyalkylene-polyamines; (xiii) metal salts of alkyl salicylates; (xiv) amine salts of alkylphosphoric acids; (xv) fatty esters; (xvi) condensation products of carboxylic acids or equivalents with polyols and mixtures thereof.

Representatives of each of these types of friction modifiers are known and are commercially available. For instance, (i) includes components generally of the formulas:

$(RO)_2PHO$, $(RO)(HO)PHO$, and $P(OR)(OR)(OR)$, wherein, in these structures, the term "R" is conventionally referred to as an alkyl group but may also be hydrogen. It is, of course, possible that the alkyl group is actually alkenyl and thus the terms "alkyl" and "alkylated," as used herein, will embrace other than saturated alkyl groups within the component. The component should have sufficient hydrocarbyl groups to render it substantially oleophilic. In some embodiments the hydrocarbyl groups are substantially unbranched. Many suitable such components are available commercially and may be synthesized as described in U.S. Pat. No. 4,752,416. In some embodiments the component contains 8 to 24 carbon atoms in each of R groups. In other embodiments the component may be a fatty phosphite containing 12 to 22 carbon atoms in each of the fatty radicals, or 16 to 20 carbon atoms. In one embodiment the fatty phosphite can be formed from oleyl groups, thus having 18 carbon atoms in each fatty radical.

The (iv) borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula:

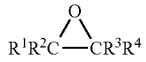

wherein each of $R^1$, $R^2$, $R^3$ and $R^4$ is hydrogen or an aliphatic radical, or any two thereof together with the epoxy carbon atom or atoms to which they are attached, form a cyclic radical. The fatty epoxide preferably contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° C. to 250° C., preferably 100° C. to 200° C., for a period of time sufficient for reaction to take place. If desired, the reaction may be effected in the presence of a substantially inert, normally liquid organic diluent. During the reaction, water is evolved and may be removed by distillation.

The (iii) non-borated fatty epoxides, corresponding to Reagent B above, are also useful as friction modifiers.

Borated amines are generally known from U.S. Pat. No. 4,622,158. Borated amine friction modifiers (including (ix) borated alkoxylated fatty amines) are conveniently prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at a 50° C. to 300° C., preferably 100° C. to 250° C. or 130° C. to 180° C., with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10]cocoamine); ETHOMEEN™ S/12 (bis[2-hydroxyethyl]soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl]octadecylamine); and ETHOMEEN™ 18/25 (polyoxyethylene[15]octadecylamine). Fatty amines and ethoxylated fatty amines are also described in U.S. Pat. No. 4,741,848. Dihydroxyethyl tallowamine (commercially sold as ENT-12™) is included in these types of amines.

The (viii) alkoxylated fatty amines, and (v) fatty amines themselves (such as oleylamine and dihydroxyethyl tallowamine) are generally useful as friction modifiers in this disclosure. Such amines are commercially available.

Both borated and unborated fatty acid esters of glycerol can be used as friction modifiers. The (vii) borated fatty acid esters of glycerol are prepared by borating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent such as methanol, benzene, xylenes, toluene, or oil.

The (vi) fatty acid esters of glycerol themselves can be prepared by a variety of methods well known in the art. Many of these esters, such as glycerol monooleate and glycerol tallowate, are manufactured on a commercial scale. The esters useful are oil-soluble and are preferably prepared from C8 to C22 fatty acids or mixtures thereof such as are found in natural products and as are described in greater detail below. Fatty acid monoesters of glycerol are preferred, although, mixtures of mono- and diesters may be used. For example, commercial glycerol monooleate may contain a mixture of 45% to 55% by weight monoester and 55% to 45% diester.

Fatty acids can be used in preparing the above glycerol esters; they can also be used in preparing their (x) metal salts, (ii) amides, and (xii) imidazolines, any of which can also be used as friction modifiers. Preferred fatty acids are those containing 10 to 24 carbon atoms, or 12 to 18. The acids can be branched or straight-chain, saturated or unsaturated. In some embodiments the acids are straight-chain acids. In other embodiments the acids are branched. Suitable acids include decanoic, oleic, stearic, isostearic, palmitic, myristic, palmitoleic, linoleic, lauric, and linolenic acids, and the acids from the natural products tallow, palm oil, olive oil, peanut oil, corn oil, coconut oil and Neat's foot oil. A particularly preferred acid is oleic acid. Preferred metal salts include zinc and calcium salts. Examples are overbased calcium salts and basic oleic acid-zinc salt complexes, such as zinc oleate, which can be represented by the general formula $Zn_4Oleate_6O_1$. Preferred amides are those prepared by condensation with ammonia or with primary or secondary amines such as ethylamine and diethanolamine. Fatty imidazolines are the cyclic condensation product of an acid with a diamine or polyamine such as a polyethylenepolyamine. The imidazolines are generally represented by the structure:

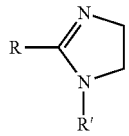

where R is an alkyl group and R' is hydrogen or a hydrocarbyl group or a substituted hydrocarbyl group, including —$(CH_2CH_2NH)n$- groups. In a preferred embodiment the friction modifier is the condensation product of a C10 to C24 fatty acid with a polyalkylene polyamine, and in particular, the product of isostearic acid with tetraethylenepentamine.

The condensation products of carboxylic acids and polyalkyleneamines (xiii) may generally be imidazolines or amides. They may be derived from any of the carboxylic acids described above and any of the polyamines described herein.

Sulfurized olefins (xi) are well known commercial materials used as friction modifiers. A particularly preferred sulfurized olefin is one which is prepared in accordance with the detailed teachings of U.S. Pat. Nos. 4,957,651 and 4,959,168. Described therein is a co-sulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one olefin. This olefin is preferably an aliphatic olefin, which usually will contain 4 to 40 carbon atoms, preferably from 8 to 36 carbon atoms. Terminal olefins, or alpha-olefins, are preferred, especially those having from 12 to 20 carbon atoms. Mixtures of these olefins are commercially available, and such mixtures are contemplated for use in this disclosure. The co-sulfurized mixture of two or more of the reactants, is prepared by reacting the mixture of appropriate reactants with a source of sulfur. The mixture to be sulfurized can contain 10 to 90 parts of Reactant (1), or 0.1 to 15 parts by weight of Reactant (2); or 10 to 90 parts, often 15 to 60 parts, more often 25 to 35 parts by weight of Reactant (3), or 10 to 90 parts by weight of reactant (4). The mixture, in the present disclosure, includes Reactant (3) and at least one other member of the group of reactants identified as reactants (1), (2) and (4). The sulfurization reaction generally is effected at an elevated temperature with agitation and optionally in an inert atmosphere and in the presence of an inert solvent. The sulfurizing agents useful in the process of the present disclosure include elemental sulfur, which is preferred, hydrogen sulfide, sulfur halide plus sodium sulfide, and a mixture of hydrogen sulfide and sulfur or sulfur dioxide. Typically often 0.5 to 3 moles of sulfur are employed per mole of olefinic bonds. Sulfurized olefins may also include sulfurized oils such as vegetable oil, lard oil, oleic acid and olefin mixtures.

Metal salts of alkyl salicylates (xiii) include calcium and other salts of long chain (e.g. C12 to C16) alkyl-substituted salicylic acids.

Amine salts of alkylphosphoric acids (xiv) include salts of oleyl and other long chain esters of phosphoric acid, with amines as described below. Useful amines in this regard are tertiary-aliphatic primary amines, sold under the tradename Primene™.

In some embodiments the friction modifier is a fatty acid or fatty oil, a metal salt of a fatty acid, a fatty amide, a sulfurized fatty oil or fatty acid, an alkyl phosphate, an alkyl phosphate amine salt; a condensation product of a carboxylic acid and a polyamine, a borated fatty epoxide, a fatty imidazoline, or combinations thereof.

In other embodiments the friction modifier may be the condensation product of isostearic acid and tetraethylene pentamine, the condensation product of isostearic acid and 1-[tris(hydroxymethyl)]methylamine, borated polytetradecyloxirane, zinc oleate, hydroxylethyl-2-heptadecenyl imidazoline, dioleyl hydrogen phosphate, C14-C18 alkyl phosphate or the amine salt thereof, sulfurized vegetable oil, sulfurized lard oil, sulfurized oleic acid, sulfurized olefins, oleyl amide, glycerol monooleate, soybean oil, or mixtures thereof.

In still other embodiments the friction modifier may be glycerol monooleate, oleylamide, the reaction product of isostearic acid and 2-amino-2-hydroxymethyl-1,3-propanediol, sorbitan monooleate, 9-octadecenoic acid, isostearyl amide, isostearyl monooleate or combinations thereof.

Although their presence is not required to obtain the benefit of this disclosure, friction modifiers may be used from zero to 2 wt %, preferably 0.01 wt % to 1.5 wt % of the lubricating oil composition. These ranges may apply to the amounts of individual friction modifier present in the composition or to the total friction modifier component in the compositions, which may include a mixture of two or more friction modifiers.

Many friction modifiers tend to also act as emulsifiers. This is often due to the fact that friction modifiers often have non-polar fatty tails and polar head groups. Emulsibility, or rather decreased demulsibility, is a result that is undesirable in hydraulic fluids, where it is desirable for such compositions to remain separate from and not entrain any water with which the fluid may come into contact. The friction modifiers of the present disclosure may be used to improve the antiwear performance of the hydraulic fluid, however in some embodiments care must be taken to avoid using the friction modifier at a level that would negatively impact the demulsibility of the fluid.

The lubricating oils of this disclosure exhibit desired properties, e.g., wear control, in the presence or absence of a friction modifier.

Although their presence is not required to obtain the benefit of this disclosure, useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

Molybdenum-Containing Compounds (Friction Reducers)

Illustrative molybdenum-containing friction reducers useful in the disclosure include, for example, an oil-soluble decomposable organo molybdenum compound, such as Molyvan™ 855 which is an oil soluble secondary diarylamine defined as substantially free of active phosphorus and active sulfur. The Molyvan™ 855 is described in Vanderbilt's Material Data and Safety Sheet as a organomolybdenum compound having a density of 1.04 and viscosity at 100° C. of 47.12 cSt. In general, organo molybdenum compounds are preferred because of their superior solubility and effectiveness.

Another illustrative molybdenum-containing compound is Molyvan™ L which is sulfonated oxymolybdenum dialkyldithiophosphate described in U.S. Pat. No. 5,055,174 hereby incorporated by reference.

Molyvan™ A made by R. T. Vanderbilt Company, Inc., New York, N.Y., USA, is also an illustrative molybdenum-containing compound which contains about 28.8 wt. % Mo, 31.6 wt. % C, 5.4 wt. % H., and 25.9 wt. % S. Also useful are Molyvan™ 855, Molyvan™ 822, Molyvan™ 856, and Molyvan™ 807.

Also useful is Sakura Lube™ 500, which is more soluble Mo dithiocarbamate containing lubricant additive obtained from Asahi Denki Corporation and comprised of about 20.2 wt. % Mo, 43.8 wt. % C, 7.4 wt. % H, and 22.4 wt. % S. Sakura Lube™ 300, a low sulfur molybdenum dithiophosphate having a molybdenum to sulfur ratio of 1:1.07, is a preferred molybdenum-containing compound useful in this disclosure.

Also useful is Molyvan™ 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R. T. Vanderbilt and marketed as an antioxidant and antiwear additive.

Other sources are molybdenum $Mo(Co)_6$, and molybdenum octoate, $MoO(C_7H_{15}CO_2)_2$ containing about 8 wt-% Mo marketed by Aldrich Chemical Company, Milwaukee, Wis. and molybdenum naphthenethioctoate marketed by Shephard Chemical Company, Cincinnati, Ohio.

Inorganic molybdenum compounds such as molybdenum sulfide and molybdenum oxide are substantially less preferred than the organic compounds as described in Molyvan™ 855, Molyvan™ 822, Molyvan™ 856, and Molyvan™ 807.

Illustrative molybdenum-containing compounds useful in this disclosure are disclosed, for example, in U.S. Patent Application Publication No. 2003/0119682, which is incorporated herein by reference.

Organo molybdenum-nitrogen complexes may also beneficial in these formulations. The term "organo molybdenum nitrogen complexes" embraces the organo molybdenum nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that disclosure; the spectrum identifies an ester carbonyl band at 1740 cm 1 and an amide carbonyl band at 1620 cm 1. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri nuclear molybdenum sulfur compounds described in EP 1 040 115 and WO 99/31113, and the molybdenum complexes described in U.S. Pat. No. 4,978,464.

Although their presence is not required to obtain the benefit of this disclosure, molybdenum-containing additives may be used from zero to 5.0 percent by mass. More preferred dosage is up to 3,000 ppm by mass, more preferably from about 100 ppm to about 2,500 ppm by mass, more preferably from about 300 to about 2,000 ppm by mass, more preferably from 300 to about 1,500 ppm by mass of molybdenum.

Borated Ester Compounds

Illustrative boron-containing compounds useful in this disclosure include, for example, a borate ester, a boric acid, other boron compounds such as a boron oxide. The boron compound is hydrolytically stable and is utilized for improved antiwear, and performs as a rust and corrosion inhibitor for copper bearings and other metal engine components. The borated ester compound acts as an inhibitor for corrosion of metal to prevent corrosion of either ferrous or non-ferrous metals (e.g. copper, bronze, brass, titanium, aluminum and the like) or both, present in concentrations in which they are effective in inhibiting corrosion.

Patents describing techniques for making basic salts of sulfonic, carboxylic acids and mixtures thereof include U.S. Pat. Nos. 5,354,485; 2,501,731; 2,616,911; 2,777,874; 3,384,585; 3,320,162; 3,488,284; and 3,629,109. The disclosures of these patents are hereby incorporated by reference. Methods of preparing borated overbased compositions are found in U.S. Pat. Nos. 4,744,920; 4,792,410; and PCT publication WO 88/03144. The disclosures of these references are hereby incorporated by reference. The oil-soluble neutral or basic salts of alkali or alkaline earth metals salts may also be reacted with a boron compound.

An illustrative borate ester utilized in this disclosure is manufactured by Exxon-Mobil USA under the product designation of ("MCP 1286") and MOBIL ADC700. Test data show the viscosity at 100° C. using the D-445 method is 2.9 cSt; the viscosity at 40° C. using the D-445 method is 11.9; the flash point using the D-93 method is 146; the pour point using the D-97 method is −69; and the percent boron as determined by the ICP method is 5.3%. The borated ester (Vanlube™ 289), which is marketed as an antiwear/antiscuff additive and friction reducer, is a preferred borate ester useful in this disclosure.

An illustrative borate ester useful in this disclosure is the reaction product obtained by reacting about 1 mole fatty oil, about 1.0 to 2.5 moles diethanolamine followed by subsequent reaction with boric acid to yield about 0.1 to 3 percent boron by mass. It is believed that the reaction products may include one or both of the following two primary components, with the further listed components being possible components when the reaction is pushed toward full hydration:

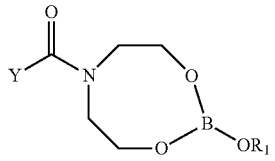

and/or

-continued

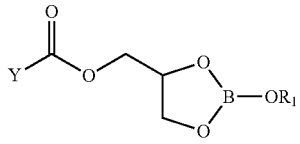

where $R_1$ = H or $C_xH_y$
where x = 1 to 60,
and y = 3 to 121

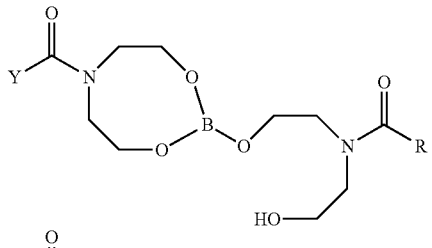

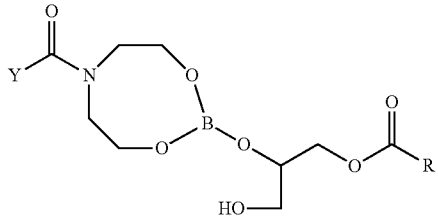

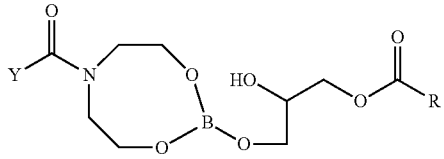

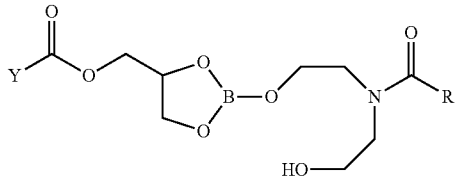

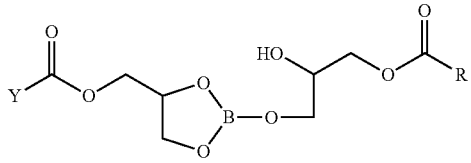

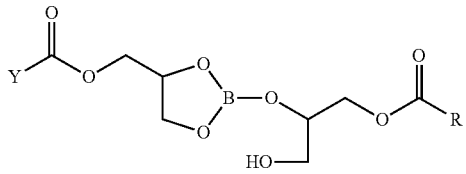

wherein Y represents a fatty oil residue. The preferred fatty oils are glyceryl esters of higher fatty acids containing at least 12 carbon atoms and may contain 22 carbon atoms and higher. Such esters are commonly known as vegetable and animal oils. Vegetable oils particularly useful are oils derived from coconut, corn, cottonseed, linseed, peanut, soybean and sunflower seed. Similarly, animal fatty oils such as tallow may be used.

The source of boron is boric acid or materials that afford boron and are capable of reacting with the intermediate reaction product of fatty oil and diethanolamine to form a borate ester composition.

While the above organoborate ester composition is specifically discussed above, it should be understood that other organoborate ester compositions should also function with similar effect in the present disclosure, such as those set forth in U.S. Patent Application Publication No. 2003/0119682, which is incorporated herein by reference. In addition, dispersions of borate salts, such as potassium borate, may also be useful.

Other illustrative organoborate compositions useful in this disclosure are disclosed, for example, in U.S. Patent Application Publication No. 2008/0261838, which is incorporated herein by reference.

In addition, other illustrative oranoborate compositions useful in this disclosure are disclosed, for example, U.S. Pat. Nos. 4,478,732, 4,406,802, 4,568,472 on borated mixed hydroxyl esters, alkoxylated amides, and amines; U.S. Pat. No. 4,298,486 on borated hydroxyethyl imidazolines; U.S. Pat. No. 4,328,113 on borated alkyl amines and alkyl diamines; U.S. Pat. No. 4,370,248 on borated hydroxyl-containing esters, including GMO; U.S. Pat. No. 4,374,032 on borated hydroxyl-containing hydrocarbyl oxazolines; U.S. Pat. No. 4,376,712 on borated sorbitan esters; U.S. Pat. No. 4,382,006 on borated ethoxylated amines; U.S. Pat. No. 4,389,322 on ethoxylated amides and their borates; U.S. Pat. No. 4,472,289 on hydrocarbyl vicinal diols and alcohols and ester mixtures and their borates; U.S. Pat. No. 4,522,734 on borates of hydrolyzed hydrocarbyl epoxides; U.S. Pat. No. 4,537,692 on etherdiamine borates; U.S. Pat. No. 4,541,941 on mixtures containing vicinal diols and hydroxyl substituted esters and their borates; U.S. Pat. No. 4,594,171 on borated mixtures of various hydroxyl and/or nitrogen containing borates; and U.S. Pat. No. 4,692,257 on various borated alcohols/diols, which are incorporated herein by reference.

Although their presence is not required to obtain the benefit of this disclosure, boron-containing compounds may be used up from zero to 10.0% percent, more preferably from about 0.01% to about 5%, and most preferably from about 0.1% to about 3.0%. An effective elemental boron range of up to 1000 ppm or less than 1% elemental boron. Thus, a preferred concentration of elemental boron is from 100 to 1000 ppm and more preferably from 100 to 300 ppm.

When lubricating oil compositions contain one or more of the additives discussed above, the additive(s) are blended into the composition in an amount sufficient for it to perform its intended function. Typical amounts of such additives useful in the present disclosure are shown in Table 3 below.

It is noted that many of the additives are shipped from the additive manufacturer as a concentrate, containing one or more additives together, with a certain amount of base oil diluents. Accordingly, the weight amounts in Table 3 below, as well as other amounts mentioned herein, are directed to the amount of active ingredient (that is the non-diluent portion of the ingredient). The weight percent (wt %) indicated below is based on the total weight of the lubricating oil composition.

TABLE 3

Typical Amounts of Industrial Lubricating Oil Components

| Compound | Approximate wt % (Useful) | Approximate wt % (Preferred) |
|---|---|---|
| Dispersant | 0-20 | 0-3 |
| Detergent | 0-20 | 0-3 |
| Friction Modifier | 0-5 | 0-1.5 |
| Antioxidant | 0.1-5 | 0.1-3 |
| Pour Point Depressant (PPD) | 0.0-5 | 0.01-1.5 |
| Antifoam Agent | 0.001-3 | 0.001-0.3 |
| Demulsifier | 0.001-3 | 0.001-0.15 |
| Viscosity Modifier (solid polymer basis) | 0.1-2 | 0.1-1 |
| Antiwear | 0.2-3 | 0.5-1.5 |
| Inhibitor and Antirust | 0.01-5 | 0.01-2 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

The following non-limiting examples are provided to illustrate the disclosure.

EXAMPLES

Formulations were prepared containing the ingredients described in FIGS. 1 and 2. All of the ingredients used herein are commercially available.

The base oils used in the formulations are described in FIGS. 1 and 2. The additives and additive systems used in the formulations are described in FIG. 2.

The base oils used in the formulations cover a range of chemical types and API base stock groups. The base oils include those made from Fischer-Tropsch (GTL) processes, a low viscosity polyalphaolefin (PAO), synthetic esters (phthalate and polyol), and alkylated naphthalene (AN).

The additive systems used in the formulations included conventional additives in conventional amounts. Conventional additives used in the formulations were one or more of an antioxidant, dispersant, pour point depressant, detergent, corrosion inhibitor, metal deactivator, seal compatibility additive, anti-foam agent, inhibitor, anti-rust additive, optional friction modifier, optional antiwear additive, and other optional lubricant performances additives.

For comparison, a well-known manufacturer's turbine oil specification is also described in FIG. 1, showing the narrow range of properties required for the lubricant: including a minimum allowable viscosity of 28.8 cSt at 40° C.

Properties of the formulations were determined according to ASTM procedures identified in FIGS. 1 and 3. The properties of the formulations are set forth in FIGS. 1 and 3.

In FIGS. 1 and 3, bearing temperature reduction, translating into a calculated efficiency benefit, was assessed using a low loss "bearing test rig test." The bearing test rig test used a scaled down standard 4-tilt pad bearing with flooded lubrication. The bearing housing was instrumented with resistance temperature detectors to measure lubricant inlet and drain temperatures. Shaft speeds and bearing loads were applied in specific combinations, consistent with typical operating conditions of power generation turbines. The measured lubricant inlet and drain temperatures at specific speeds and loads were then used to calculate the power losses of the test lubricant.

Three different commercial additive systems were used, imparting performance properties for different turbine applications, such as gas turbine use versus combined cycle steam and gas turbine application. It is well known that reducing lubricant viscosity generally lowers traction and churning losses, and this may be the most important factor determining efficiency in full-film, flooded contacts (as in turbine bearings).

Indeed, the lowest viscosity lubricant in this testing (Example 4) showed a slight efficiency benefit compared to a commercial product of typical viscosity (Comparative Example 1), However, the lowest viscosity lubricant did not deliver the most significant energy saving. Surprisingly, as shown in FIG. 1, Inventive Examples 1-3 all showed efficiency benefits far greater than Example 4.

The key performance criteria for candidates included showing greater than 15% efficiency improvement while meeting the following requirements: a flash point greater than 215° C.; absolute maximum evaporation loss less than 4%; balanced low viscosity candidate with low specific heat/low density; and maintains all bearing protection and lubricant requirements.

Contrary to previous understanding, these results show that for a turbine oil, viscosity reduction alone is not sufficient to achieve significant efficiency improvement. Balancing viscosity with volatility and density requirements is important for achieving the unexpected efficiency results. Statistical analysis of the data was used to develop the relationship for a new parameter, Lubricating Efficiency Factor, determined as follows:

Lubricating Efficiency Factor=[19.200(Specific Heat)]−[6.679(Evaporation Loss)]−[1.028(Dynamic Viscosity)]−12.178.

Candidates with a Lubricating Efficiency Factor greater than 10 showed overall better efficiency gain in the bearing testing results shown in FIGS. 1 and 3. In addition, Group V base stocks may be added to further enhance these performance attributes and provide the additive solvency and deposit control necessary for reliability in the turbine application.

PCT and EP Clauses:

1. A lubricating oil having a composition comprising a lubricating oil base stock, as a major component; and one or more lubricating oil additives, as minor components; wherein the lubricating oil has a kinematic viscosity of 16 cSt to 22 cSt at 40° C. according to ASTM D445, a density of 0.8 g/ml to 0.9 g/ml according to ASTM D1298, and an absolute evaporation loss at 150° C. of less than 4% according to ASTM D972.

2. A method for improving energy efficiency in a turbomachine lubricated with a lubricating oil by using as the lubricating oil a formulated oil, said formulated oil having a composition comprising a lubricating oil base stock as a major component; and one or more lubricating oil additives, as minor components; wherein the formulated oil has a kinematic viscosity of 16 cSt to 22 cSt at 40° C. according to ASTM D445, a density of 0.8 g/ml to 0.9 g/ml according to ASTM D1298, and an absolute evaporation loss at 150° C. of less than 4% according to ASTM D972.

3. A method of improving solubility, compatibility and/or dispersancy of polar lubricating oil additives in a nonpolar lubricating oil base stock, said method comprising:

providing a lubricating oil comprising a nonpolar lubricating oil base stock as a major component and one or more polar lubricating oil additives as a minor component; wherein the lubricating oil has a kinematic viscosity of 16 cSt to 22 cSt at 40° C. according to ASTM D445, a density of 0.8 g/ml to 0.9 g/ml according to ASTM D1298, and an absolute evaporation loss at 150° C. of less than 4% according to ASTM D972; and blending at least one co-base stock in the lubricating oil.

4. A method for improving energy efficiency in a turbomachine, said method comprising:

selecting a lubricating oil comprising a nonpolar lubricating oil base stock as a major component and one or more polar lubricating oil additives as a minor component; wherein the lubricating oil has a specific heat from 3.0 J/g·° C. to 3.3 J/g·° C., an absolute evaporation loss at 150° C. of less than 4% according to ASTM D972, and a kinematic viscosity of 16 cSt to 22 cSt at 40° C. according to ASTM D445; and wherein the nonpolar lubricating oil base stock is selected such that the lubricating oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

5. The lubricating oil of clause 1 and the methods of clauses 2-4 wherein the lubricating oil further has a Noack volatility of less than 15% according to ASTM D5800, a flash point greater than 215° C. according to ASTM D92, and a specific heat from 3.0 J/g·° C. to 3.3 J/g·° C.

6. The lubricating oil of clause 1 and the methods of clauses 2-4 wherein the lubricating oil is a lubricating turbine oil.

7. The lubricating oil of clause 1 and the methods of clauses 2-4 wherein the lubricating oil base stock comprises a Group I base oil, a Group II base oil, a Group III base oil, a Group IV base oil, a Group V base oil, or mixtures thereof.

8. The lubricating oil of clause 1 and the methods of clauses 2-4 wherein the lubricating oil further comprises at least one co-base stock.

9. The lubricating oil of clause 1 and the methods of clauses 2-4 wherein the one or more lubricating oil additives comprise an antifoam agent, a demulsifier, an antioxidant, an antiwear agent, or an antirust additive.

10. The lubricating oil of clause 1 and the methods of clauses 2-4 wherein the one or more lubricating oil additives further comprise a viscosity modifier, a detergent, a dispersant, a pour point depressant, a corrosion inhibitor, a metal deactivator, or an inhibitor.

11. The lubricating oil of clause 1 and the methods of clauses 2-4 wherein the lubricating oil base stock is selected such that the lubricating oil exhibits at least 10% improvement in energy efficiency compared to the same lubricating oil formulated to an ISO VG 32, as evaluated by a bearing efficiency test rig test.

12. The lubricating oil of clause 1 and the methods of clauses 2-4 wherein the lubricating oil base stock is selected such that the lubricating oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

13. The lubricating oil of clause 1 and the methods of clauses 2-4 wherein, in a turbomachine, energy efficiency is improved as compared to energy efficiency achieved using a lubricating oil having a kinematic viscosity of 16 cSt to 22 cSt at 40° C. according to ASTM D445, but not having a density of 0.8 g/ml to 0.9 g/ml according to ASTM D1298, or an absolute evaporation loss at 150° C. of less than 4% according to ASTM D972.

14. The lubricating oil of clause 1 and the methods of clauses 2-4 wherein, in a turbomachine, bearing temperature is reduced as compared to bearing temperature achieved using a lubricating oil having a kinematic viscosity of 16 cSt to 22 cSt at 40° C. according to ASTM D445, but not having a density of 0.8 g/ml to 0.9 g/ml according to ASTM D1298, or an absolute evaporation loss at 150° C. of less than 4% according to ASTM D972.

15. The lubricating oil of clause 1 and the methods of clauses 2-4 wherein, in a turbomachine, energy efficiency is improved and deposit control and lubricating oil additive solvency are maintained or improved as compared to energy efficiency, deposit control and lubricating oil additive solvency achieved using a lubricating oil having a kinematic viscosity of 16 cSt to 22 cSt at 40° C. according to ASTM D445, but not having a density of 0.8 g/ml to 0.9 g/ml according to ASTM D1298, or an absolute evaporation loss at 150° C. of less than 4% according to ASTM D972.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A lubricating turbine oil having a composition comprising a lubricating oil base stock, present in an amount of from about 90 weight percent to about 99 weight percent, based on the total weight of the lubricating turbine oil; and one or more lubricating oil additives, present in an amount of from about 0.1 weight percent to about 10 weight percent, based on the total weight of the lubricating turbine oil; wherein the lubricating turbine oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972, wherein the lubricating oil base stock is selected such that the lubricating turbine oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

2. The lubricating turbine oil of claim 1 which further has a Noack volatility of less than about 15% according to ASTM D5800, a flash point greater than about 215° C. according to ASTM D92, and a specific heat from about 3.0 J/g·° C. to about 3.3 J/g·° C.

3. The lubricating turbine oil of claim 1 wherein, in a turbomachine, energy efficiency is improved as compared to energy efficiency achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

4. The lubricating turbine oil of claim 1 wherein, in a turbomachine, bearing temperature is reduced as compared to bearing temperature achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

5. The lubricating turbine oil of claim 1 wherein, in a turbomachine, energy efficiency is improved and deposit control and lubricating oil additive solvency are maintained or improved as compared to energy efficiency, deposit control and lubricating oil additive solvency achieved using a lubricating oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

6. The lubricating turbine oil of claim 1 wherein the lubricating oil base stock comprises a Group I base oil, a Group II base oil, a Group III base oil, a Group IV base oil, a Group V base oil, or mixtures thereof.

7. The lubricating turbine oil of claim 1 which further comprises at least one co-base stock.

8. The lubricating turbine oil of claim 1 wherein the one or more lubricating oil additives comprise an antifoam agent, a demulsifier, an antioxidant, an antiwear agent, or an antirust additive.

9. The lubricating turbine oil of claim 8 wherein the one or more lubricating oil additives further comprise a viscosity modifier, a detergent, a dispersant, a pour point depressant, a corrosion inhibitor, a metal deactivator, or an inhibitor.

10. The lubricating turbine oil of claim 1, wherein the lubricating oil base stock is selected such that the lubricating turbine oil exhibits at least 10% improvement in energy efficiency compared to the same lubricating turbine oil formulated to an ISO VG 32, as evaluated by a bearing efficiency test rig test.

11. A method for improving energy efficiency in a turbomachine lubricated with a lubricating turbine oil by using as the lubricating turbine oil a formulated oil, said formulated oil having a composition comprising a lubricating oil base stock, present in an amount of from about 90 weight percent to about 99 weight percent, based on the total weight of the lubricating turbine oil; and one or more lubricating oil additives, present in an amount of from about 0.1 weight percent to about 10 weight percent, based on the total weight of the lubricating turbine oil; wherein the formulated oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972, wherein the lubricating oil base stock is selected such that the lubricating turbine oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

12. The method of claim 11 wherein the lubricating turbine oil further has a Noack volatility of less than about 15% according to ASTM D5800, a flash point greater than about 215° C. according to ASTM D92, and a specific heat from about 3.0 J/g·° C. to about 3.3 J/g·° C.

13. The method of claim 11 wherein, in a turbomachine, energy efficiency is improved as compared to energy efficiency achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

14. The method of claim 11 wherein, in a turbomachine, bearing temperature is reduced as compared to bearing temperature achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

15. The method of claim 11 wherein, in a turbomachine, energy efficiency is improved and deposit control and lubricating oil additive solvency are maintained or improved as compared to energy efficiency, deposit control and lubricating oil additive solvency achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

16. The method of claim 11 wherein the lubricating oil base stock comprises a Group I base oil, a Group II base oil, a Group III base oil, a Group IV base oil, a Group V base oil, or mixtures thereof.

17. The method of claim 11 wherein the lubricating turbine oil further comprises at least one co-base stock.

18. The method of claim 11 wherein the one or more lubricating oil additives comprise a defoamant, a demulsifier, an antioxidant, an antiwear agent, or an antirust additive.

19. The method of claim 18 wherein the one or more lubricating oil additives further comprise a viscosity modifier, a detergent, a dispersant, a pour point depressant, a corrosion inhibitor, a metal deactivator, or an inhibitor.

20. The method of claim 11 wherein the turbomachine is a gas turbine, or a combined cycle comprising a gas turbine and a steam turbine.

21. The method of claim 11, where the lubricating oil base stock is selected such that the lubricating turbine oil exhibits at least 10% improvement in energy efficiency compared to the same lubricating oil formulated to an ISO VG 32, as evaluated by a bearing efficiency test rig test.

22. A method of improving solubility, compatibility and/or dispersancy of polar lubricating oil additives in a nonpolar lubricating oil base stock, said method comprising:

providing a lubricating turbine oil comprising a nonpolar lubricating oil base stock present in an amount of from about 90 weight percent to about 99 weight percent, based on the total weight of the lubricating turbine oil and one or more polar lubricating oil additives present in an amount of from about 0.1 weight percent to about 10 weight percent, based on the total weight of the lubricating turbine oil; wherein the lubricating turbine oil has a kinematic viscosity of about 16 cSt to about 22 cSt at 40° C. according to ASTM D445, a density of about 0.8 g/ml to about 0.9 g/ml according to ASTM D1298, and an absolute evaporation loss at 150° C. of less than about 4% according to ASTM D972; and blending at least one co-base stock in the lubricating turbine oil, wherein the lubricating oil base stock is selected such that the lubricating turbine oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

23. The method of claim 22 wherein the lubricating turbine oil further has a Noack volatility of less than about 15% according to ASTM D5800, a flash point greater than about 215° C. according to ASTM D92, and a specific heat from about 3.0 J/g·° C. to about 3.3 J/g·° C.

24. The method of claim 22 wherein, in a turbomachine, solubility, compatibility and/or dispersancy is improved as compared to solubility, compatibility and/or dispersancy achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

25. The method of claim 22 wherein, in a turbomachine, solubility, compatibility and/or dispersancy is improved and deposit control is maintained or improved as compared to solubility, compatibility and/or dispersancy and deposit control achieved using a lubricating turbine oil having a kinematic viscosity of about 16 cSt to about 22 cSt at 40° C. according to ASTM D445, but not having a density of about 0.8 g/ml to about 0.9 g/ml according to ASTM D1298, or an absolute evaporation loss at 150° C. of less than about 4% according to ASTM D972.

26. The method of claim 22 wherein the lubricating oil base stock comprises a Group I base oil, a Group II base oil, a Group III base oil, a Group IV base oil, a Group V base oil, or mixtures thereof.

27. The method of claim 22 wherein the at least one co-base stock is a polar co-base stock.

28. The method of claim 22 wherein the one or more lubricating oil additives comprise a defoamant, a demulsifier, an antioxidant, an antiwear agent, or an antirust additive.

29. The method of claim 22 wherein the one or more lubricating oil additives further comprise a viscosity modifier, a detergent, a dispersant, a pour point depressant, a corrosion inhibitor, a metal deactivator, or an inhibitor.

30. A method for improving energy efficiency in a turbomachine, said method comprising:

selecting a lubricating turbine oil comprising a nonpolar lubricating oil base stock present in an amount of from about 90 weight percent to about 99 weight percent, based on the total weight of the lubricating turbine oil and one or more polar lubricating oil additives present in an amount of from about 0.1 weight percent to about 10 weight percent, based on the total weight of the lubricating turbine oil; wherein the lubricating turbine oil has a specific heat from about 3.0 J/g·° C. to about 3.3 J/g·° C., an absolute evaporation loss at 150° C. of less than about 4% according to ASTM D972, and a kinematic viscosity of about 16 cSt to about 22 cSt at 40° C. according to ASTM D445; and wherein the nonpolar lubricating oil base stock is selected such that the lubricating turbine oil possesses a Lubricating Efficiency Factor of at least 10, according to the following formula:

Lubricating Efficiency Factor=[19.200(Specific Heat)]−[6.679(Evaporation Loss)]−[1.028(Dynamic Viscosity)]−12.178.

31. The method of claim 30 wherein the turbomachine is a gas turbine, or a combined cycle comprising a gas turbine and a steam turbine.

* * * * *